US006275668B1

(12) United States Patent
Batori

(10) Patent No.: US 6,275,668 B1
(45) Date of Patent: Aug. 14, 2001

(54) DEVELOPING DEVICE, PROCESS CARTRIDGE AND ELECTRICAL CONTACT PART

(75) Inventor: Yoshiyuki Batori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/317,160

(22) Filed: May 24, 1999

(30) Foreign Application Priority Data

May 22, 1998 (JP) ..... 10-158462

(51) Int. Cl.[7] ..... G03G 15/00
(52) U.S. Cl. ..... 399/90; 399/111
(58) Field of Search ..... 399/90, 75, 88, 399/37, 107, 110, 111, 117, 119, 159, 265; 439/188, 526, 924.1; 174/59

(56) References Cited

U.S. PATENT DOCUMENTS

| | | | | |
|---|---|---|---|---|
| 5,210,574 | * | 5/1993 | Kita | 399/117 |
| 5,241,343 | * | 8/1993 | Nishio | 399/90 |
| 5,283,619 | * | 2/1994 | Nomura et al. | 399/90 |
| 5,634,175 | | 5/1997 | Michlin et al. | 399/90 |
| 5,682,587 | * | 10/1997 | Higeta et al. | 399/277 |
| 5,768,658 | * | 6/1998 | Watanabe et al. | 399/111 |
| 5,815,782 | | 9/1998 | Yokomori et al. | 399/285 |
| 5,870,655 | * | 2/1999 | Nishiuwatoko et al. | 399/111 |
| 5,911,096 | | 6/1999 | Batori et al. | 399/111 |
| 5,920,753 | | 7/1999 | Sasaki et al. | 399/111 |
| 5,930,562 | | 7/1999 | Noda et al. | 399/114 |
| 5,937,237 | | 8/1999 | Nonaka et al. | 399/106 |
| 5,940,658 | | 8/1999 | Yokoi et al. | 399/119 |

FOREIGN PATENT DOCUMENTS

| | | | |
|---|---|---|---|
| 466 173 | | 1/1992 | (EP) . |
| 754 984 | | 1/1997 | (EP) . |
| 5-257378 | * | 10/1993 | (JP) . |
| 8-305256 | | 11/1996 | (JP) . |
| 9-15967 | | 1/1997 | (JP) . |

OTHER PUBLICATIONS

Patent Abstracts of Japan, vol. 1997, No. 05, May 30, 1997 (JP–09–015967).

Patent Abstracts of Japan, vol. 1997, No. 63, Mar. 31, 1997 (JP–8–305256).

* cited by examiner

*Primary Examiner*—Sophia S. Chen
(74) *Attorney, Agent, or Firm*—Fitzpatrick, Cella, Harper & Scinto

(57) ABSTRACT

An electrical contact part supplies a bias voltage to a developing roller usable in a process cartridge detachably mountable to a main assembly of an electrophotographic image forming apparatus. The apparatus includes an electrophotographic photosensitive member, a developing roller for developing an electrostatic latent image formed on the electrophotographic photosensitive member, an electroconductive flange engaged to one end portion of the developing roller, and a driving portion, provided at on end portion of the flange, for rotating the developing roller. The electrical contact part includes (a) a connecting portion electrically connectable with a cartridge-side electrode which is provided in the process cartridge and which is connectable with a main assembly side electrode provided in the main assembly of the apparatus when the process cartridge is detachably mounted to the main assembly of the apparatus; and (b) a projected portion projected at a side opposite from a side at which the connecting portion is connectable to the cartridge side electrode and insertable to between the flange and the driving portion.

58 Claims, 17 Drawing Sheets

DEVELOPING DEVICE, PROCESS CARTRIDGE AND ELECTRICAL CONTACT PART

FIELD OF THE INVENTION AND RELATED ART

The present invention relates to a developing device and a process cartridge which are detachably mountable to an electrophotographic image forming apparatus, and an electrical contact part for the same.

An electrophotographic image forming apparatus is an apparatus that forms an image on a recording material using an electrophotographic image forming process, and includes an electrophotographic copying machines, an electrophotographic printer (LED printer, a laser beam printer or the like), an electrophotographic-printer-type facsimile machine and an electrophotographic-printer-type word processor.

A process cartridge is a cartridge that contains charging means, cleaning means, developing means and an electrophotographic photosensitive member as a unit, which is detachably mountable to a main assembly of an electrophotographic image forming apparatus. It may contain developing means and an electrophotographic photosensitive member and at least one of charging means and cleaning means. It may contain at least developing means and an electrophotographic photosensitive member.

These and other objects, features and advantages of the present invention will become more apparent upon a consideration of the following description of the preferred embodiments of the present invention taken in conjunction with the accompanying drawings.

Referring first to FIG. 28, an example of a conventional developing device will be described.

In the conventional example, the image forming apparatus uses a process cartridge containing a unit process means, such as an electrophotographic photosensitive member, a charger, a developing device or a cleaning device. The process cartridge is detachably mountable to a main assembly of the image forming apparatus, so that maintenance or servicing is made easier.

The process cartridge has a developing apparatus for visualizing an electrostatic latent image formed on the photosensitive drum with a developer (toner). A developing roller unit is provided in the developing apparatus, and has a fixed magnet therein to carry the toner in the developing apparatus on a peripheral surface of a developing roller toward the photosensitive drum.

As shown in FIG. 28, the developing roller unit comprises a cylindrical developing roller 10*d* rotatable in a predetermined direction, and a fixed magnet 10*c* disposed in the developing roller 10*d*. The opposite ends are fixed to holders 14*a*, 14*b* fixed to the main assembly of the developing device. The developing roller 10*d* and the fixed magnet 10*c* are disposed with a small gap therebetween. To the opposite ends of the developing roller 10*d*, flanges 12*a*, 12*b* are fixed by press-fitting or bonding. The flanges 12*a*, 12*b* are rotatably supported on the developing device by bearing members 23*a*, 23*b* as supporting members.

In the flange 12*a*, a sleeve electrode (compression coil spring) 25 is provided. A fixed portion 25*a* at an end of the sleeve electrode 25 is press-fitted to contact the inside of the flange 12*a*, and is fixed to the flange 12*a*. The portion other than the fixed portion 25*a* is not confined on the flange 12*a*, so that resiliency is provided. The contact portion 25*b* at the other end of the sleeve electrode 25 contacts to the electrode plate 14*c* fixed to the holder 14*a* by the resiliency, and the contact surface is coated with electroconductive grease. The electrode plate 14*c* is electrically connected to a voltage source in the main assembly of the image forming apparatus to accomplish electric bias voltage supply to the developed roller 10*d*.

By a sliding reference between the contact portion 25*b* of the sleeve electrode 25 and the electrode plate 14*c*, a force is applied in the direction of reduction of the diameter of the sleeve electrode 25, by which the press-fitting of the fixed portion 25*a* is eased. By this, the sleeve electrode 25 is liable to disengage from the flange 12*a*. In order to prevent this, the direction of winding of the sleeve electrode 25 is determined so that contact portion 25*b* of the sleeve electrode 25 and the electrode plate 14*c* are contacted counterdirectionally. By doing so, the sliding resistance leads to an increase in the coil diameter of the sleeve electrode 25.

However, the fixed portion 25*a* of the sleeve electrode 25 is in the flange 12*a*. Therefore, during the assembling in a plant, the visual inspection is performed as to the insertion and engagement of the sleeve electrode 25 with the flange. Therefore, it has been necessary for the inspector to manually pull the sleeve electrode 25 from the flange 12*a* to confirm whether the engagement is firm enough or not.

The sleeve electrode 25 is fixed to the inside of the flange 12*a*. Then, a space has to be provided for the sleeve electrode 25 by cutting a thickness of the flange 12*a*. This is disadvantageous from the standpoint of downsizing of the developing device.

SUMMARY OF THE INVENTION

Accordingly, it is a principle object of the present invention to provide an electrical contact part, a developing device and a process cartridge wherein the assembling operativity of an electrical contact part is improved.

It is another object of the present invention to provide an electrical contact part, a developing apparatus and a process cartridge wherein inspection after assembling of an electrical contact part is made easier. It is a further object of the present invention to provide an electrical contact part, a developing apparatus and a process cartridge wherein a developing bias can be stably supplied to a developing roller. According to an aspect of the present invention, there is provided and electrical contact part for supplying a bias voltage to a developing roller usable in a process cartridge detachably mountable to a main assembly of an electrophotographic image forming apparatus, which contains an electrophotographic photosensitive member, a developing roller for developing an electrostatic latent image formed on the electrophotographic photosensitive member, an electroconductive flange engaged to one end portion of the developing roller, a driving portion, provided at one end portion of the flange, for rotating the developing roller, the electrical contact part comprising (a) a connecting portion electrically connectable with a cartridge side electrode, which is provided in the process cartridge and which is connectable with a main assembly side electrode provided in the main assembly of the apparatus when the process cartridge is detachably mounted to the main assembly of the apparatus; and (b) a projected portion projected at a side opposite from a side at which the connecting portion is connectable to the cartridge side electrode and insertable to between the flange and the driving portion.

It is a further object of the present invention to provide a process cartridge detachably mountable to a main assembly of an electrophotographic image forming apparatus including (a) an electrophotographic photosensitive member; (b) a developing roller for developing the electrostatic latent image formed on the electrophotographic photosensitive member; (c) an electroconductive flange engaged with one end portion of the developing roller; (d) a driving portion, provided at one end portion of the flange, for rotating the developing roller; (e) a cartridge side electrode electrically connectable with a main assembly side electrode provided in the main assembly of the apparatus, when the process cartridge is detachably mounted to the main assembly of the apparatus; and (f) an electrical contact part for supplying a bias voltage to the developing roller, the electrical contact part including: (1) a connecting portion electrically connected to the cartridge-side electrode; (2) a projected portion projected at a side opposite from a side at which the connecting portion is connectable to the cartridge side electrode and insertable to between said flange and said driving portion.

DETAILED DESCRIPTION OF THE PREFERRED EMBODIMENTS

Referring to the accompany drawings, embodiments of the present invention will be described. As an exemplary image forming apparatus, a laser beam printer will be taken as an example thereof.

(Embodiment 1)

Referring to FIGS. 1 to 26, a process cartridge and an image forming apparatus to which the process cartridge is mountable will be described.

Figure 1:
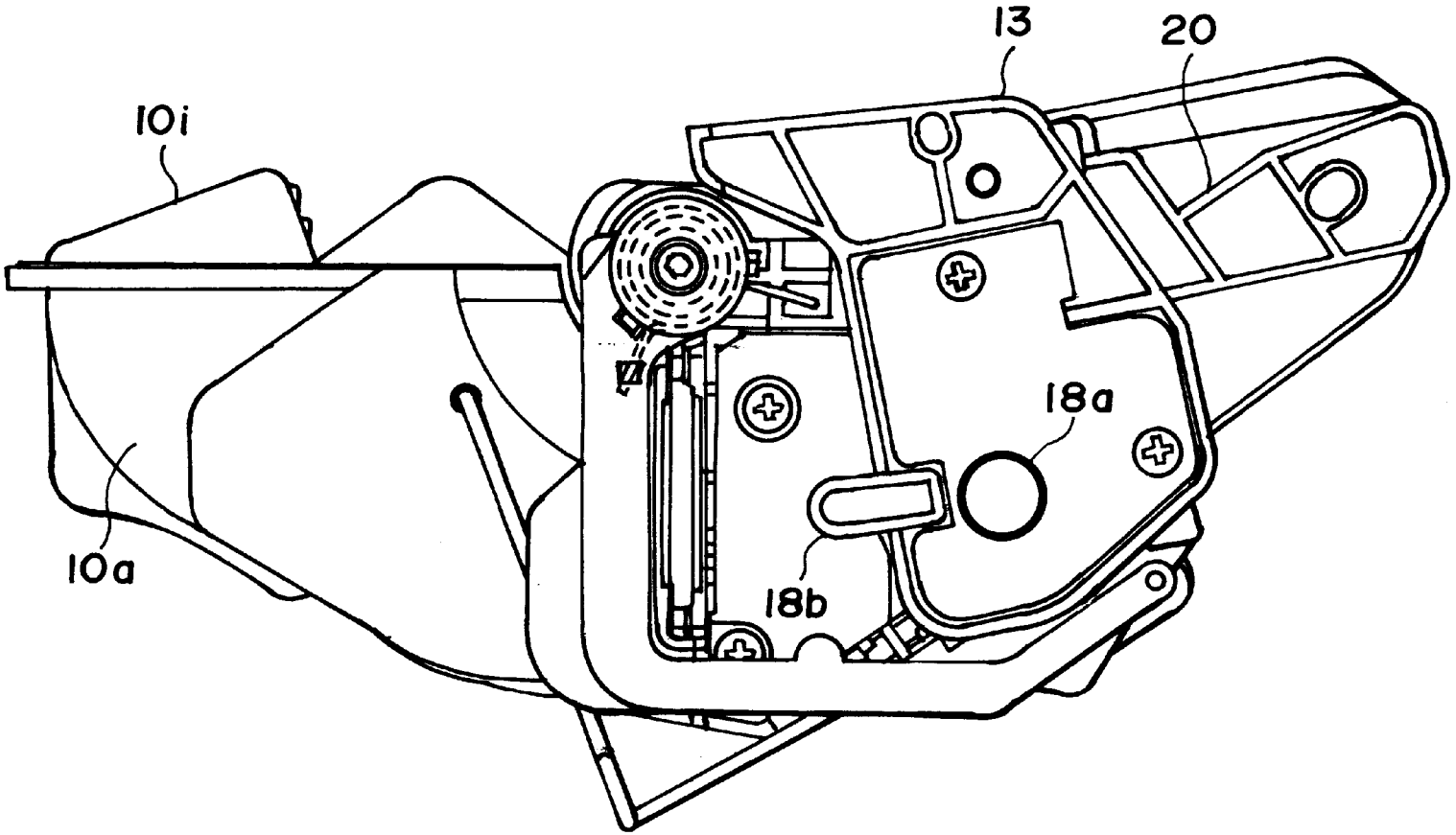
FIG. 1 is a side view of an outer appearance of a process cartridge of the present invention.
Figure 2:
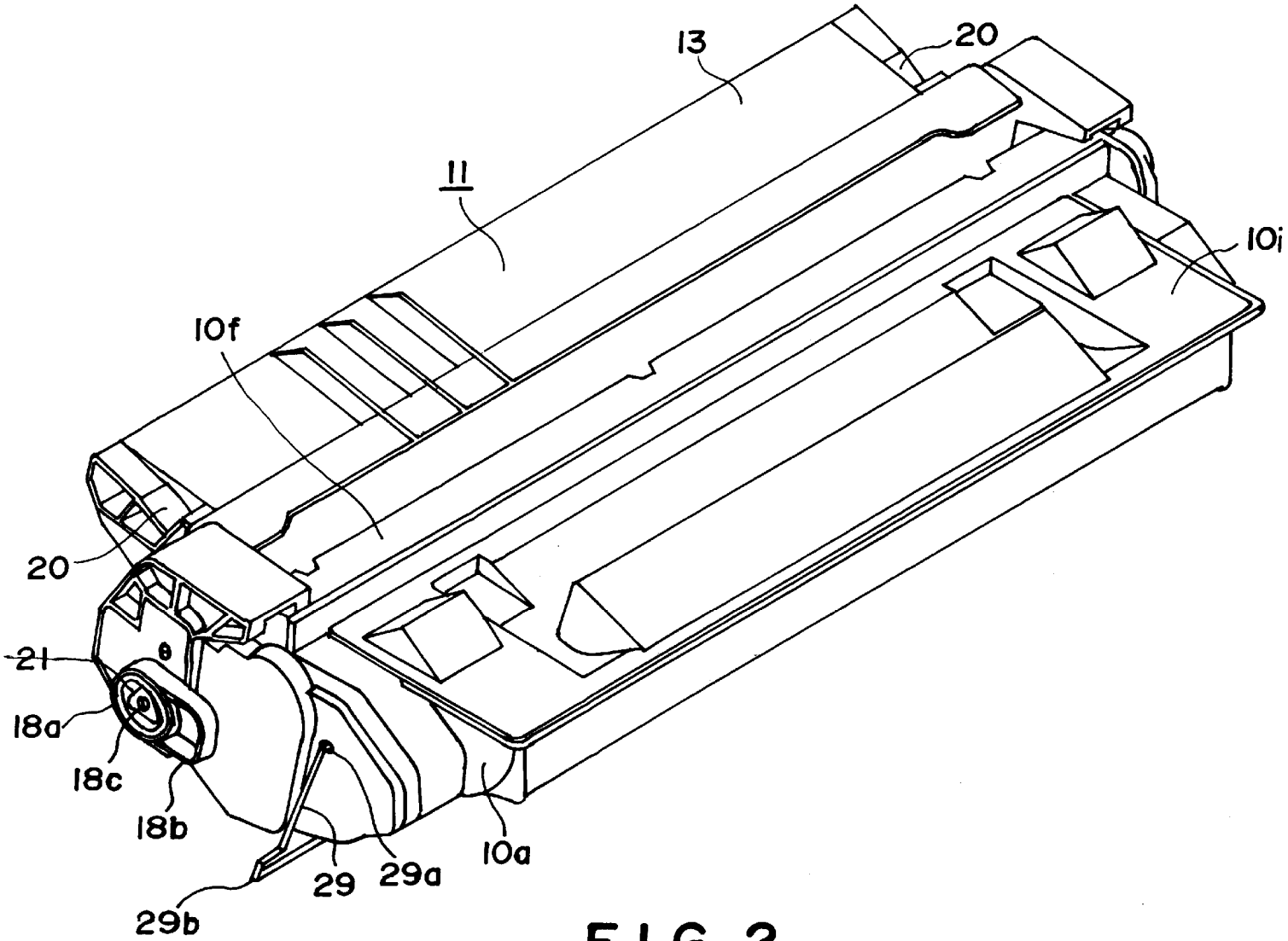
FIG. 2 is a perspective view of an outer appearance illustrating a process cartridge of the present invention.
Figure 3:
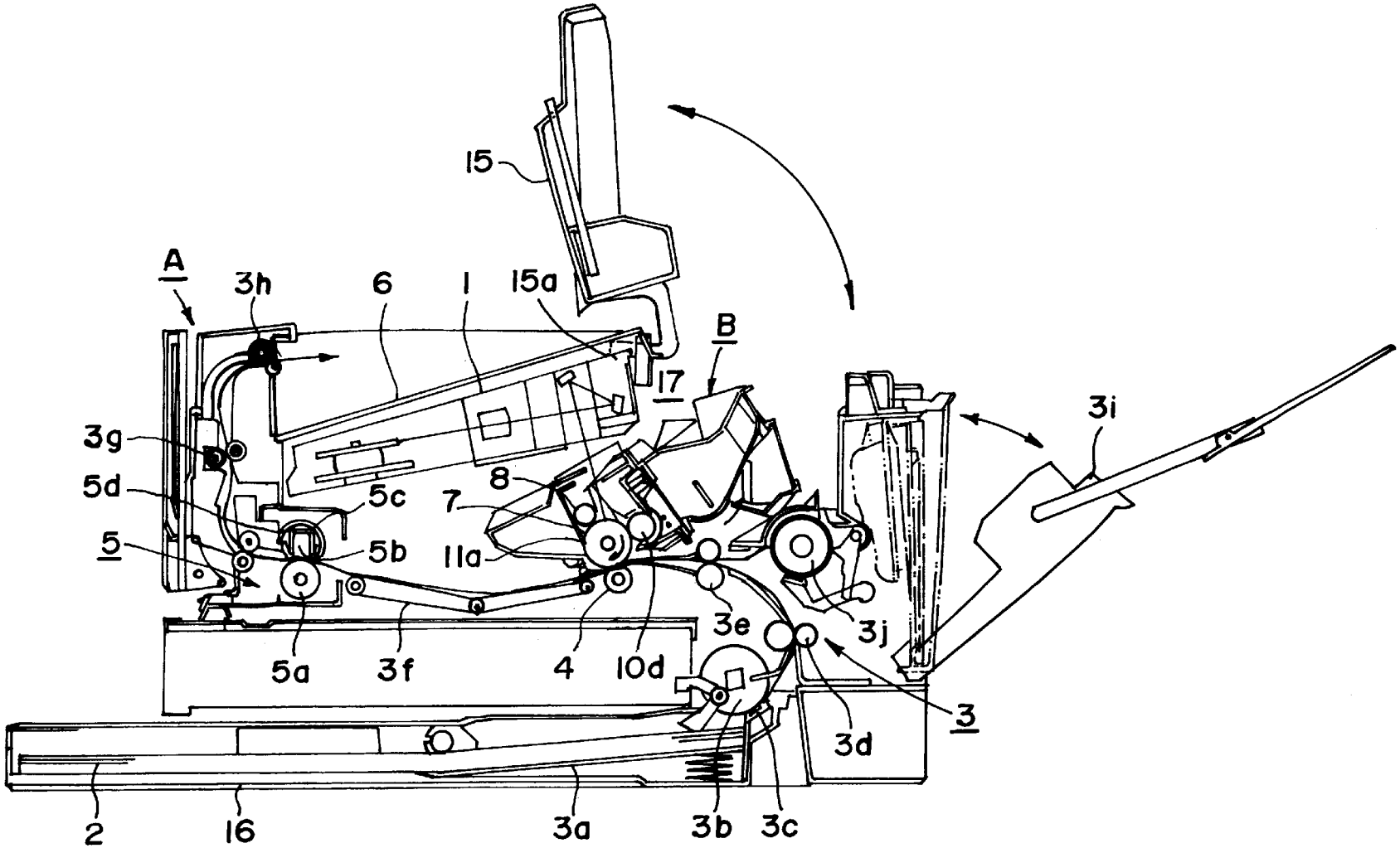
FIG. 3 is a longitudinal sectional view of an image forming apparatus to which a process cartridge of the present invention is mounted.
Figure 4:
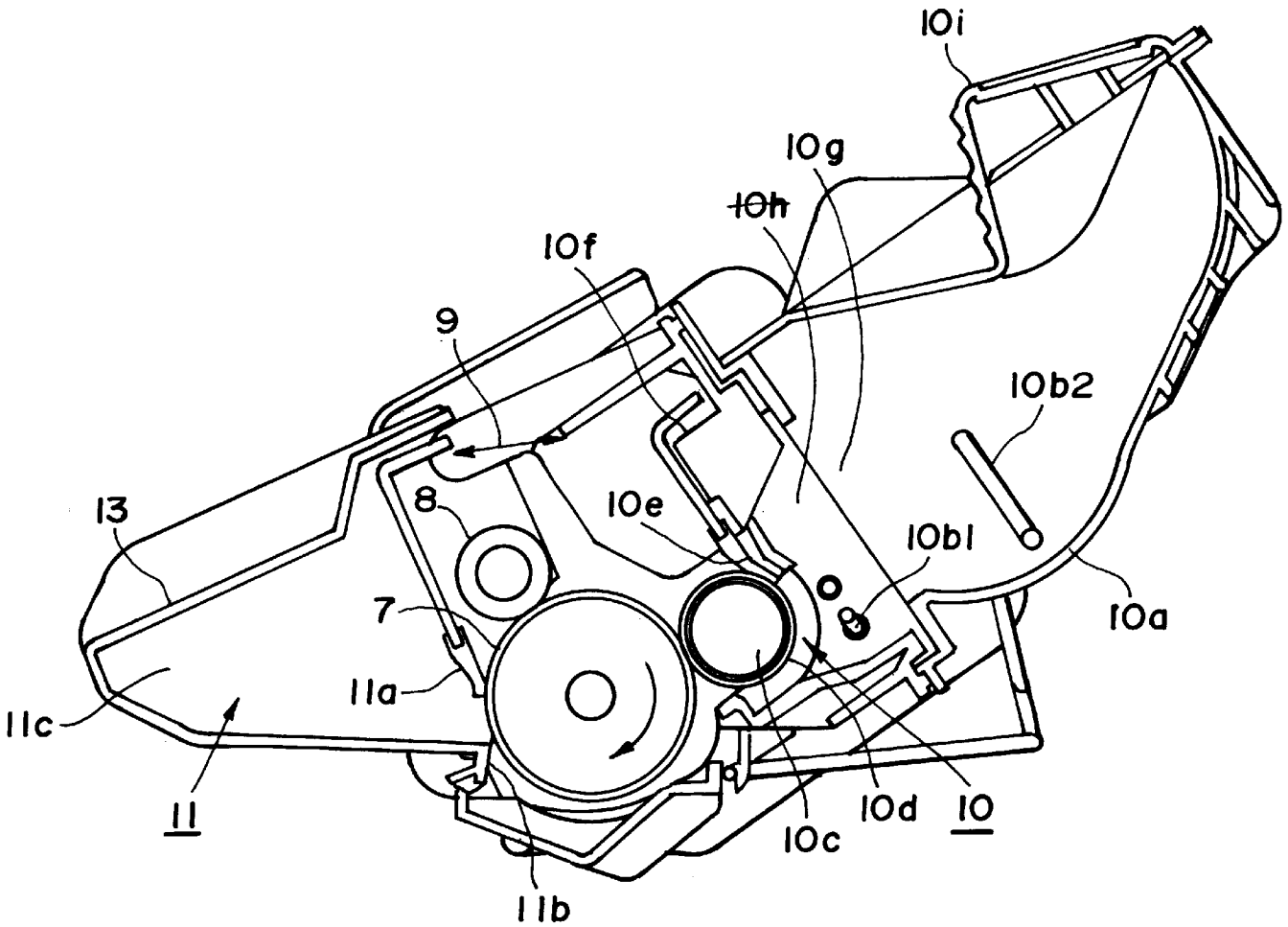
FIG. 4 is a longitudinal sectional view illustrating a structure of a process cartridge of the present invention.

FIGS. 1 and 2 are illustration of the outer appearance of the process cartridge. FIG. 3 is a schematic illustration of an image forming apparatus to which the process cartridge is mounted; FIG. 4 is a schematic illustration of the process cartridge; and FIGS. 5 to 26 are detailed views illustrating the present invention. The process cartridge and the image forming apparatus using the same will be described generally.

(General arrangement)

The electrophotographic image forming apparatus (laser beam printer) A projects information light based on image information from an optical system 1, as shown in FIG. 3, onto a photosensitive drum 7 (an electrophotographic photosensitive member in the form of a drum), by which a latent image is formed on the photosensitive drum 7. The latent image is developed with a developer into a toner image. On the other hand, a recording material 2 is separated and fed out seriatim from a cassette 3*a* by a pick-up roller 3*b* and a press-contact member 3*c* press-contacted thereto, and is fed by feeding means 3 including a pair of feeding rollers 3*d*, and a pair of registration rollers 3*e*. A toner image formed on the electrophotographic photosensitive drum is transferred onto a recording material 2 by voltage application to a transfer roller 4. Thereafter, the recording material 2 is fed to fixing means 5 by a conveyor belt 3*f*.

The fixing means 5 includes a driving roller 5*a* and a fixing rotatable member 5*d* in the form of a cylindrical sheet supported rotatably by a supporting member 5*c* which contains a heater 5*b* therein. By the application of heat and pressure to the recording material 2 passing therethrough, the transferred toner image is fixed. The recording material 2 is fed by a pair of discharging rollers 3*g*, 3*h* and is discharged to a discharging portion 6 by way of a reverse feeding path. The image forming apparatus A can be supplied with the recording material manually by a tray 3*i* and a roller 3*j*.

(Process cartridge)

On the other hand, the process cartridge B comprises and electrophotographic photosensitive member, and at least one processing means. The process means includes, for example, charging means for charging the electrophotographic photosensitive member, developing means for developing a latent image formed on the electrophotographic photosensitive member and cleaning means for removing residual toner from a surface of the electrophotographic photosensitive member. In the process cartridge B in this embodiment, as shown in FIG. 4, the surface of the photosensitive drum 7 is uniformly charged by the application of the voltage to the charging roller 8 (charging means) while the photosensitive drum 7, having a photosensitive layer, is rotated. The charged photosensitive drum 7 is exposed to a light image from an optical system 1 through an exposure opening 9 so that the electrostatic latent image is formed. Then, the latent image is developed by developing means 10.

The developing means 10 feeds the toner from a toner container in a frame 10*a* by a toner feeding member 10*b*2 to an opening 10*g*. Thereafter, the toner is fed into a toner development frame 10*f* through an opening 10*h* of the toner development frame 10*f*. Then the toner is stirred by a toner stirring member 10*b*1. The developing roller 10*d* containing therein a fixed magnet 10*c* is rotated, and a layer of toner triboelectrically charged by a developing blade 10*e* is formed on a surface of the developing roller 10*d*. The toner is transited onto the photosensitive drum 7 in accordance with the latent image, by which a toner image is formed.

The transfer roller 4 is supplied with a voltage having a polarity opposite from the toner image to transfer the toner image onto the recording material 2. Then, the cleaning blade 11*a* scrapes the toner remaining on the photosensitive drum 7 off the photosensitive drum 7. The toner thus removed is received by a receptor sheet 11*b* and is collected to a removed toner accommodating portion 11*c*. The cleaning means 11 includes the blade 11*a*, a sheet 11*b* and a toner accommodating portion 11*c*.

The process cartridge is constituted by the toner container frame 10*a* for supporting a toner feeding member 10*b*2, a toner development frame 10*f* containing a toner stirring member 10*b*1, a developing member such as a developing roller 10*d* or a developing blade 10*e*, and a cap member 10*i*, which are welded together into a unit. It also includes a cleaning frame 13, which contains the toner accommodating portion 11*c*, the photosensitive drum 7, the cleaning blade 11*a*, the receptor sheet 11*b* and the charging roller 8. The developing unit and the cleaning frame 13 constitute a cartridge frame. The process cartridge is detachably mountably to cartridge mounting means provided in the image forming apparatus A.

(Mounting-and-demounting of process cartridge relative to main assembly of image forming apparatus)

As shown in FIG. 1, a right-hand end of the process cartridge B, as seen from the toner container frame 10*a* side, is provided with a positioning guide 18*a* a cylindrical shape, projected outwardly from and co-axially with the photosensitive drum 7. Behind the positioning guide 18*a*, with respect to a direction of mounting of the process cartridge B to the main assembly 16 of the image forming apparatus, there is provided a guide 18*b* for keeping the orientation (pose) of the process cartridge B when it is mounted to the main assembly 16 of the image forming apparatus.

At a left-hand end of the process cartridge B, as seen from the toner container frame 10*a*, as shown in FIG. 2, there is provided a semi-cylindrical positioning guide 18*a* projected outwardly from and co-axially with the photosensitive drum 7. Behind the positioning guide 18*a*, as seen in the mounting direction of the process cartridge B to the main assembly 16 of the image forming apparatus, there is provided an orientation guide 18*b*.

As shown in FIG. 1, 2, left and upper right parts of the cleaning frame 13 is provided with a regulating abutment 20 for contact with a fixing member(unshown) provided in the main assembly 16 of the image forming apparatus. As shown in FIG. 3, the main assembly 16 of the image forming apparatus is provided with a cartridge mounting portion 17.

The main assembly 16 of the image forming apparatus is provided with an openable member 15 for opening and closing the cartridge mounting portion 17, the openable member 15 being mounted by a hinge 15*a*. As shown in FIG. 3, when the openable member 15, which covers the cartridge mounting portion 17, is opened by rotating it in the counterclockwise direction about the hinge 15*a*, the cartridge mounting portion 17 appears. At the left and right sides of the cartridge mounting portion 17, there is provided a cartridge guide member. The cartridge guide member is provided with a positioning guide 18*a* for the process cartridge B and a guiding lead for guiding the guide 18*b*. At the end of the guiding lead, there is provided a positioning groove into which a positioning guide 18*a* is engaged. By engagement of the positioning with the positioning groove, the position of the photosensitive drum 7 is determined relative to the main assembly 16 of the image forming apparatus. The regulating abutment 20 of the process cartridge B is abutted to a fixing member (unshown) of the main assembly 16 of the image forming apparatus so that orientation of the process cartridge B relative to the main assembly 16 of the image forming apparatus is determined.

By closing the openable member 15 thereafter, the image formation can be carried out.

(Developing roller and electrode ring)

Figure 5:
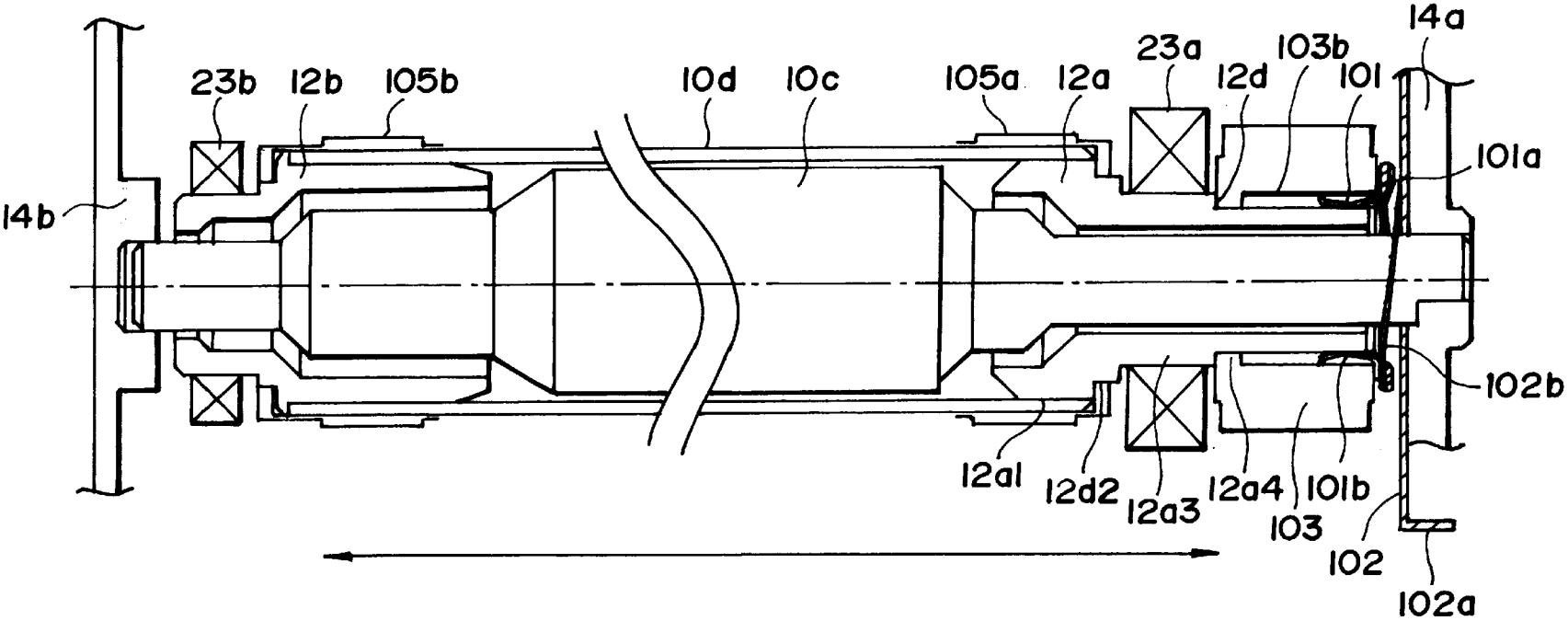
FIG. 5 is a longitudinal sectional view of a developing roller portion illustrating a structure of a process cartridge of the present invention.

As shown in FIG. 5, the developing device includes the cylindrical developing roller 10*d* (developer carrying member) rotatable in a predetermined direction and a fixed magnet 10*c* in the developing roller 10*d*.

Figure 6:
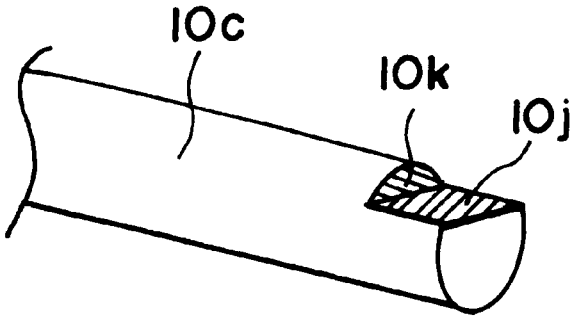
FIG. 6 is a perspective view illustrating a configuration of an end of a fixed magnet according to the present invention.

The opposite ends of the fixed magnet 10*c* are fixed by engagement with holders 14*a*, 14*b* fixed to the main assembly of the developing device. The end of the fixed magnet 10*c* near the holder 14*a* is provided with cut surfaces 10*j*. 10*k* (cut from a circular shape) as shown in FIG. 6. On the other hand, a hole complementary with the cut is provided in the holder 14*a*, so that positioning of the fixed magnet 10*c* in the rotational direction is effected by the cut 10*j*. By abutting the cut 10*k* to the holder 14*a*, the fixed magnet 10*c* is positioned correctly in the longitudinal direction.

The developing roller 10*d* and the fixed magnet 10*c* are disposed with a small gap therebetween.

The developing roller 10*d* is provided at its opposite ends with flanges 12*a*, 12*b* fixed thereto. The flange 12*a* is made of a highly electroconductive metal material (such as Al alloy, Fe alloy, Cu alloy or the like) and is press-fitted into the developing roller 10*d*.

The flange 12*b* is made of a resin material or metal and is fixed by press-fitting or bonding.

The flange 12*a*, 12*b* is rotatably supported on the developing apparatus by bearing members 23*a*, 23*b*. The bearing member 23*a* is fixed to the toner development frame 10*f* against axial-direction movement.

The movable range, in the longitudinal direction (direction indicated by the arrow in FIG. 5), of the developing roller 10*d* is regulated by the bearing members 23*a*, 23*b*.

As shown in FIG. 5, the electroconductive flange 12*a* is provided with a stepped portion 12*a*2 provided by reducing the diameter from the cylindrical mounting shaft portion 12*a*1 press-fitted to or bonded to an inner side of the developing roller 10*d*. A bearing mounting portion 12*a*3 for engagement with the bearing member 23*a* is provided in the form of a reduced diameter portion from the stepped portion 12*a*2. Continuing from the bearing mounting portion 12*a*3, a gear mounting portion 12*a*4 is provided starting with the abutment surface 12*d*. With the gear mounting portion 12*a*4, a gear 103 is engaged. The configuration of the gear mounting portion 12*a*4 will be described.

Figure 7:
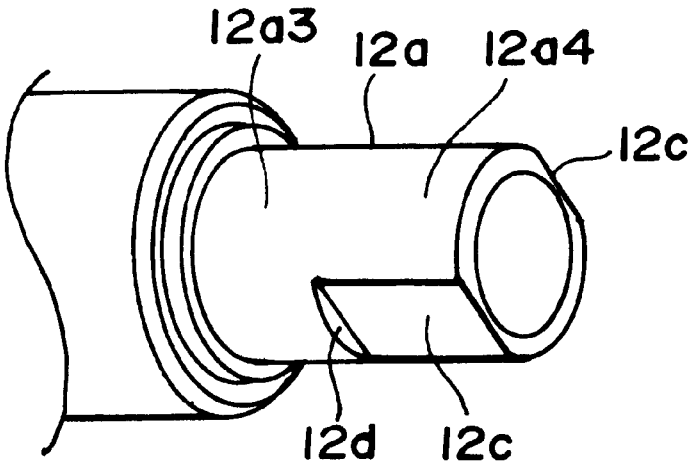
FIG. 7 is a perspective view illustrating a configuration of an end of a flange according to the present invention.
Figure 8:
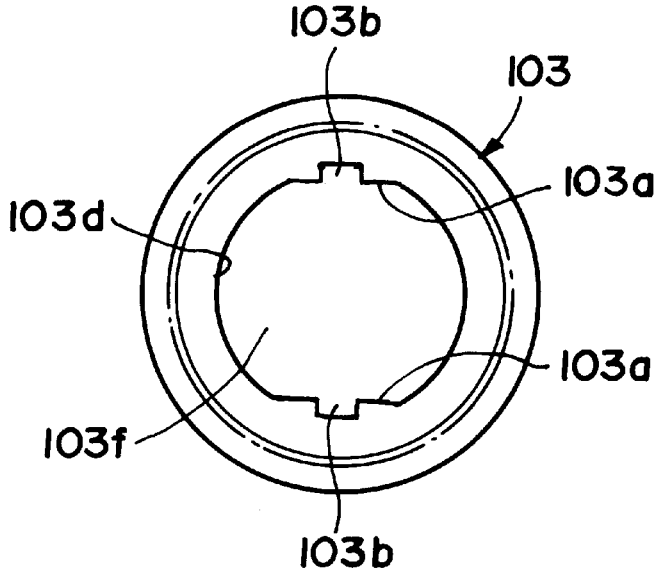
FIG. 8 is a front view of a gear of the present invention as seen along the axis.

The length of the bearing mounting portion 12*a*3 measured in the axial direction is slightly larger than the width of the bearing member 23*a*, taking a manufacturing error into account. The length of the gear mounting portion 12*a*4 measured in the axial direction is smaller than the total length of the gear 103. When the gear 103 is mounted to the gear mounting portion 12*a*4, a part of the hole of the gear 103 is recessed facing outwardly. FIG. 7 shows the configuration of a gear mounting portion 12*a*4 of the flange 12*a*. The flange 12*a* is provided with two cut-away portions 12*c* to form two parallel flats. On the other hand, the hole 103*f* of the gear 103 as shown in FIG. 8, is provided with two flat surface portions 103*a* at positions corresponding to the cut-away portions 12*c* of the flange 12*a*. Therefore, the hole 103*f* of the gear 103 has cylindrical portions 103*d* complementary with the cylindrical surface of the gear mounting portion 12*a*4 and flat surface portions 103*a*. By contact between the cut-away portion 12*c* and the flat surface portion 103*a*, the flange 12*a*, the developing roller 10*d* and the flange 12*b* are integrally rotated when the gear 103 is driven by a driving force from an unshown driving source.

By the provision of the flat surface portions 103*a*, the thickness is larger adjacent the flat surface portion 103*a* than at the other portions, the gear 103 is made of resin material in consideration of the sliding property. The gear 103 is molded from a resin material such as POM, PC, ABS or the like, and therefore, if the thickness is non-uniform, a "sink" results in the thick portion with the result of deteriorated dimensional accuracy.

As a countermeasure against this sink, a lightening groove 103*b* is provided at a part of the flat surface portion 103*a* to make the thickness uniform.

Figure 9:
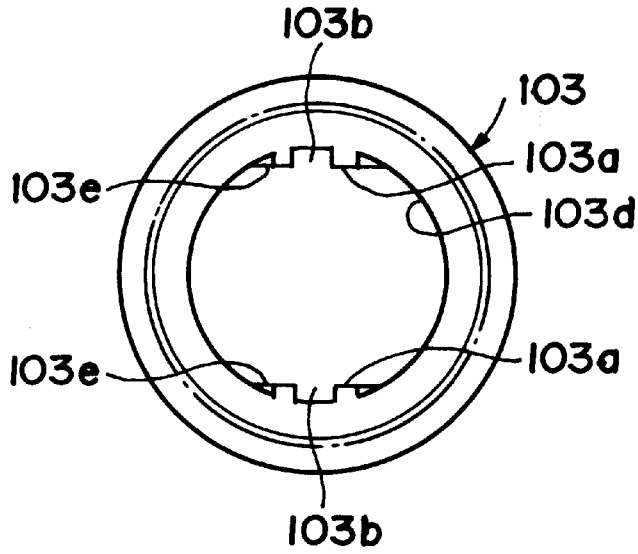
FIG. 9 is a front view of a gear of the present invention as seen along the axis.

FIG. 9 shows an example in which a groove 103*e* is provided such that cylindrical portion 103*d* enters the thick portion providing the flat surface portion 103*a*.

Figure 10:
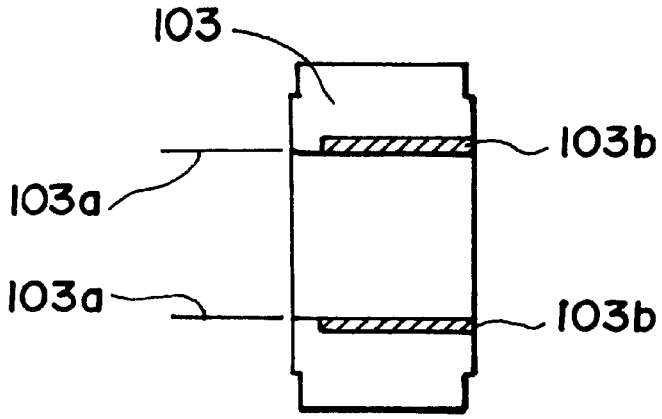
FIG. 10 is a cross-sectional view illustrating a cross-sectional configuration of a gear according to the present invention.

FIG. 10 is a sectional view taken along a plane including the center line of rotation shown in FIGS. 8, 9. In this example, the depth of the groove 104*b* is smaller than the entire width of the gear 103, but is smaller by 1.5 mm approximately, but the groove 103 *b* may be extended throughout the entire width of the gear 103.

Figure 11:
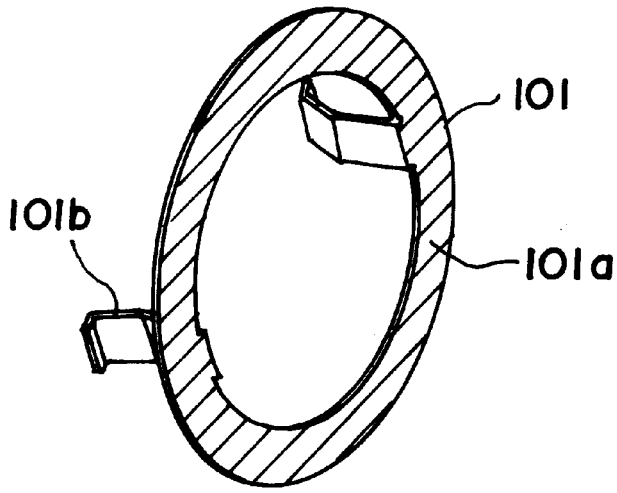
FIG. 11 is a perspective view illustrating a configuration of an electrode ring according to the present invention.

Referring to FIG. 11, the electrode ring 101 (electrical contact part) will be described. The electrode ring 101, made of an electroconductive material such as Cu alloy, Fe alloy such as SUS, comprises generally two portions. One of them is a first contact portion 101*a* in the form of a flat ring indicated by hatching lines in the figure, and the other is arm portions (extended portions) 101*b* extending from inside edge of the ring of the first contact portion 101*a*. The first contact portion 101*a* is a flat ring plate, and the flat surface portion shown in FIG. 11 is perpendicular to an axis of the developing roller 10*d* in an assembled state.

Figure 12:
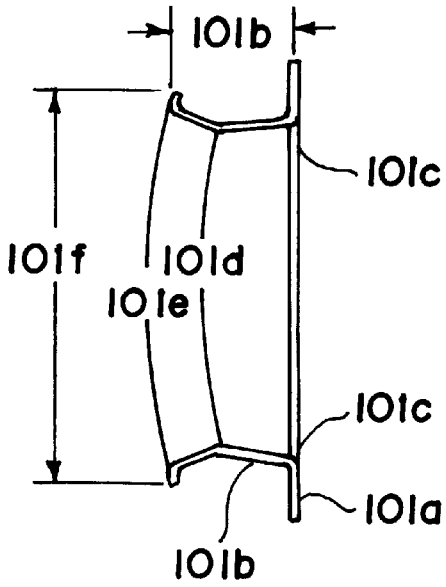
FIG. 12 is a cross-sectional view illustrating a cross-sectional configuration of an electrode ring of the present invention.

FIG. 12 show a section of the electrode ring 101. Each of the arm portion 101*b* has three bent portions, namely, a first bent portion 101*c* adjacent the first contact portion, a second bent portion 101*d* and a third bent portion 101*e*.

By curving the arm portion 101*b* by the bent portions 101*c*, 101*d*, 101*e*, the electrical contact pressure relative to the flange 12*a* can be increased. The first bent portion 101*c* bends the arm substantially perpendicularly to the flat surface portion constituting the first contact portion 101*a*. The second bent portion 101*d* bends the arm portion 101*b* such that free end side is away from the center line passing through the center of the first contact portion 101*a*. The third bent portion 101*e* is bent such that free end of the arm is nearer to the first contact portion 101*a* than the third bent portion 101*e*.

An assembly method will be described.

First, a phase alignment is carried out such that arm portions 101*b* of the electrode ring 101 enter the grooves 103*b* of the gear 103. Then, the arm portions 101*b* of the electrode ring 101 are inserted in the axial direction into the groove 103*b* of the gear 103.

Figure 13:
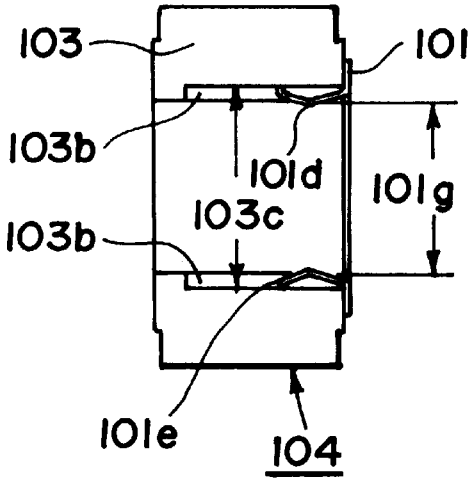
FIG. 13 is a cross-sectional view illustrating a state wherein the electrode ring of the present invention is assembled with the gear.

FIG. 13 is a sectional view illustrating the insertion, wherein a span 101*f* of the free end of the arm portion 101*b* in a free state of the electrode ring 101 (FIG. 12) and an inner diameter span 103*c* of the groove 103*b* of the gear 103 satisfy:

101*f* >103*c*

Therefore, each of the arm portions 101*b* deforms by (span 101*f* of the free end- inner diameter span 103*c*)/2.

The third bent portion 101*e* is formed such that the free end of the arm portion 101*b* smoothly slide on the bottom surface of the groove 1 to the gear 103. Thus, smooth insertion is accomplished. On the other hand, in that direction of demounting the electrode ring 101, the free end of the arm portion 101*b* tends to bite into the bottom of the groove 103*b*, so that removal is impeded. By the deformation, the gear 103 receives a reaction force corresponding to the load required by the deformation, from the free end of the arm portion 101*b*.

By the reaction force, a frictional force is produced at the contact portion between the gear 103 and the electrode ring 101 and the free end of the arm portion 101*b*, so that electrode ring 101 is not easily removed from the gear 103 after it is mounted thereto.

Therefore, after the electrode ring 101 is mounted in an assembling line in a plant, the electrode ring 101 is assuredly retained.

Then, the connected part 104 comprising the gear 103 and the electrode ring 101 is mounted to the flange 12*a*, as shown in FIG. 13. Before the connected part 104 is mounted to the flange 12*a*, a spacer 105*a* and a bearing member 23*a* are mounted as shown in FIG. 5.

Figure 14:
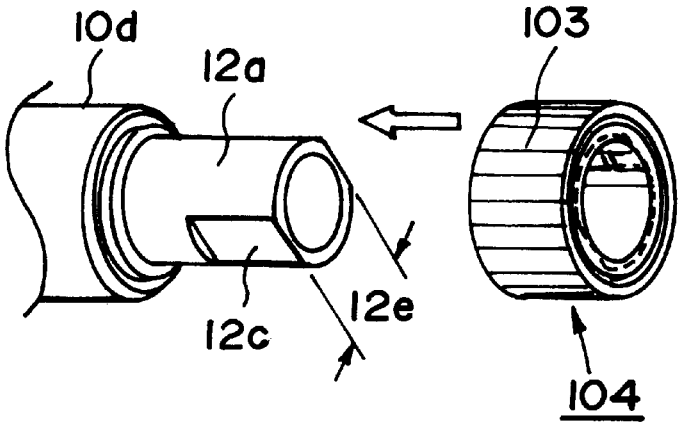
FIG. 14 is a perspective view illustrating insertion of a connecting part of the present invention into a flange.

As described hereinbefore, the flange 12*a* is provided with cut-away portions 12*c* at the outer periphery thereof as shown in FIG. 7. Then, the phase alignment is carried out so that cut-away portions 12*c* and the flat surface portions 103*a* of the gear 103 of the connecting part 104 are aligned, and then the connecting part 104 is inserted into the flange 12*a* (FIG. 14).

Figure 15:
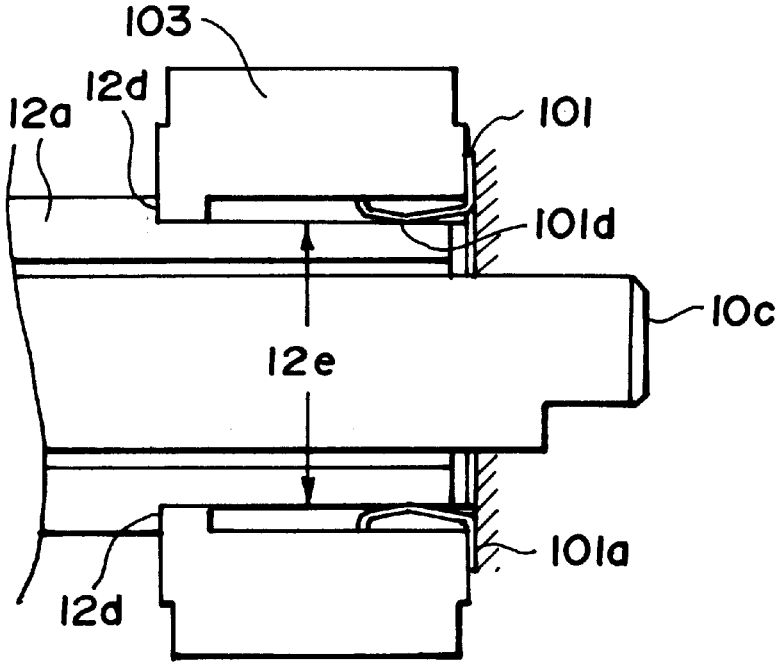
FIG. 15 is a cross-sectional view illustrating a state wherein a connected part of the present invention is inserted into a flange.

FIG. 15 shows the state after this insertion, wherein bearing member 23*a* is omitted for better understanding. Upon insertion of the connected part 104, a surface of the first contact portion 101 *a* of the electrode ring (hatched portion in FIG. 15) is pushed to insert it until the end surface of the gear 103 abuts a crescent abutment 12*d* (FIG. 15 or 7).

Figure 16:
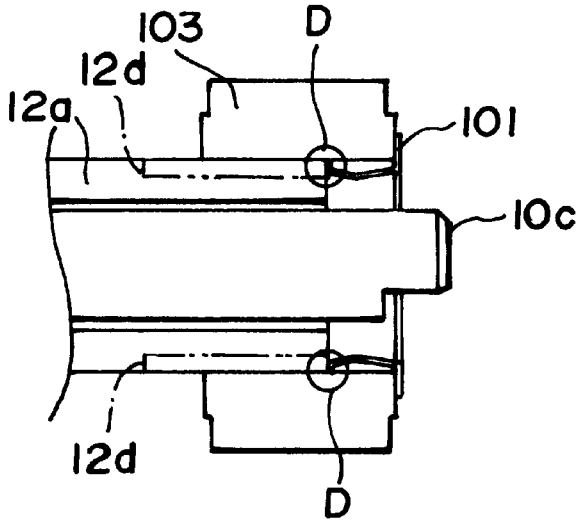
FIG. 16 is a cross-sectional view illustrating the capability of detection of erroneous assembling in the present invention.
Figure 17:
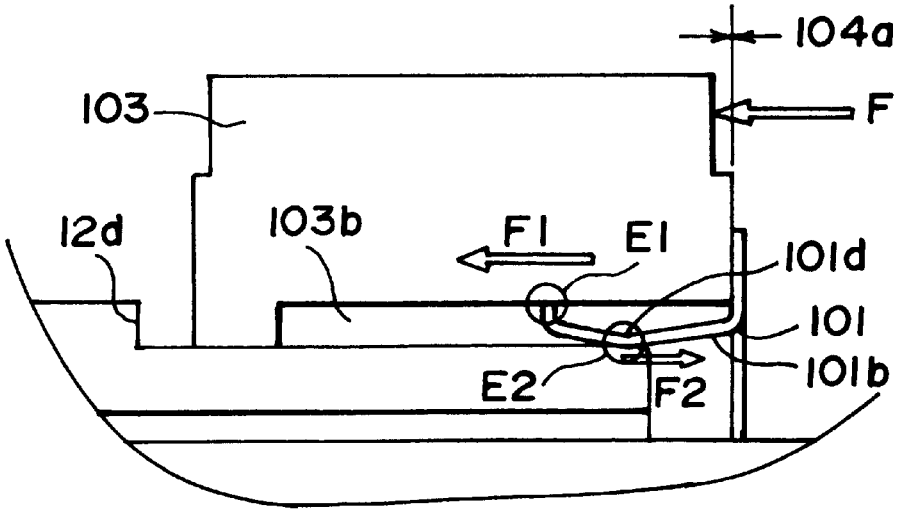
FIG. 17 is a longitudinal sectional view illustrating re-assembling according to the present invention.

If the electrode ring 101 were inserted into the flange 12*a* such that the arm portion 101*b* are not aligned with the grooves 103*b* of the gear 103, the neighborhoods of the free ends of the arm portions 101*b* would abut the end surface of the flange 12*a* (D in FIG. 16). Therefore, it could not be inserted until the end surface of the gear 103 abutted the crescent abutment 12*d*.

The span 101*g* ((FIG. 13) of the second bent portions of the electrode ring 101 in the connected part 104 and the span 12*e* (FIG. 14) between the cuts 12*c* of the flange 12*a*, satisfy:

101*g*>12*e*

Therefore, each of the arm portions 101*b* deforms by (span between the cuts 12*e*—span 101*g* between the second portions)/2.

Upon the insertion, the bent portion 101*d* of the arm portion 101*b* contacts the cut-away portions 12*c* of the flange 12*a* so that smooth insertion is accomplished.

By the deformation, repelling forces are produced between the flange 12*a* and the arm portion 101*b* and between the gear 103 and the arm portion 101*b*. Therefore, the connecting part 104 does not easily become offset from the regular positions, so that electric conduction at the contact at each of the two portions of the connecting part 104 of the reception is assured.

In FIG. 14, the gear 103 is shown as a spur gear. However, the gear 103 may be a helical gear. When a helical gear is used and if a force is produced in the direction of deviating the connecting part 104 from the inserted position (direction opposite from that indicated by the arrow in FIG. 14) during a developing operation of the developing device, the force retaining the unification of the flange 12*a*, the electrode plate 102, and the gear 103 is larger than the deviating force because of the repelling force resulting from the deformation of the arm portion 101*b*, and therefore, the connecting part 104 is not loosened. This has been confirmed empirically. Therefore, the distance from the electrode plate 102, which will be described hereinafter, is maintained constant.

Even if the deviation occurred, inspection is easily carried out by visual inspection of whether the end surface of the gear 103 abutts the abutment surface 12*d* (FIGS. 15 or 7). Therefore, when the deviation is found, the surface (hatched portion in FIG. 15) of the first contact portion 101*a* of the electrode ring 101 is pushed to reinsert it. Even if a double error occurred by which a force F were applied to a gear 103 without pushing the surface (hatched portion in FIG. 15) of the first contact portion 101*a* of the electrode ring 101 (FIG. 17), no problem would arises. This is because the frictional force F2 applied at the contact portion E2 between the flange 12*a* and the second bent portion 101*d* of the arm portion 101*b* is smaller than the tension force F1 produced at the arm portion 101*b* in the contact portion E1 between the gear 103 and the free end of the arm portion 101*b*, since the gear 103 is made of resin material, and therefore, the free and more or less bites into the resin material. Accordingly, the electrode ring 101 is inserted with close contact to the gear 103 when the gear 103 is moved, so that insertion does not end without the gap 104*a*.

In the above-described structure, the contact portion of the electrode ring 101 relative to the flange 12*a* is provided on the outer surface rather than the inner surface of the flange 12*a*, so that the strength of the flange 12*a* does not deteriorate. Additionally, the space of the groove 103*b* provided in the gear 103 for the lightening is efficiently utilized, and therefore, no disadvantage results.

The foregoing, when the gear 103 is mounted to the flange 12*b* axially opposite from the developing bias contact portion, a member having the same inner shape as the gear 103 is used.

(Holder side electrode)

A description will be provided as to an electrode plate 102 provided in the holder 14*a*.

Figure 18:
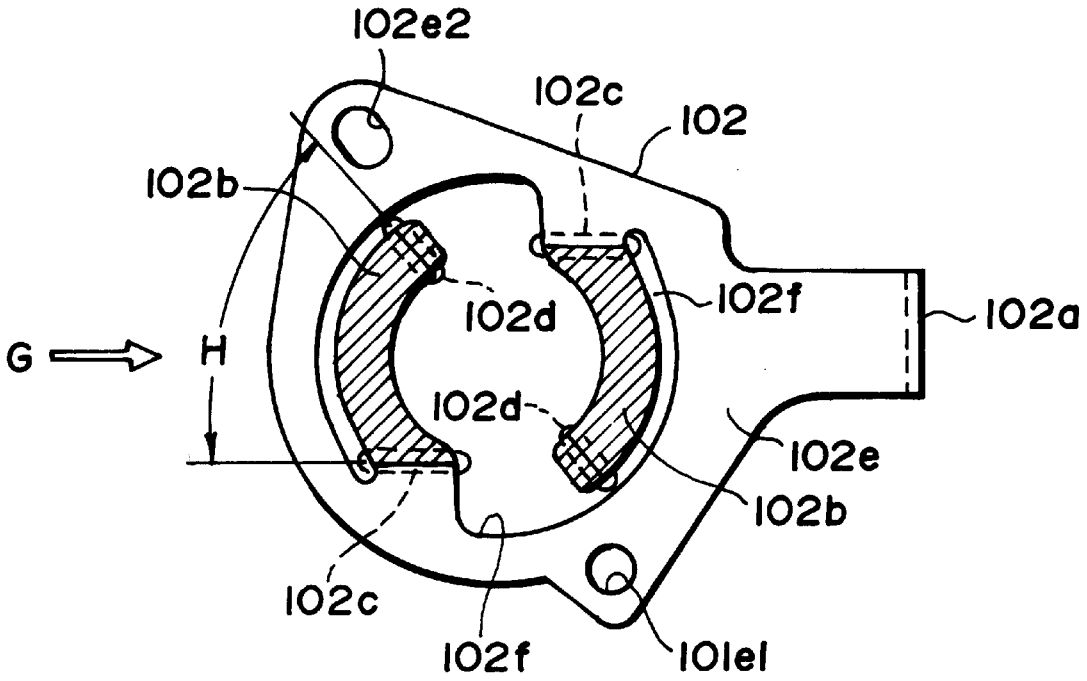
FIG. 18 is a front view illustrating a proper electrode plate in the present invention.

FIG. 18 is a top plan view illustrating the electrode plate 102.

The electrode plate 102 is made of electroconductive material such as Fe alloy, such as SUS or a Cu alloy or the like. There are provided a contact 102*a* for contact with an electrode (unshown) extending from a high voltage source of the image forming apparatus and arm portions 102*b* for contact with the electrode ring 101 (two portions indicated by hatching lines).

Each of the arm portions 102*b* has a first bent portion 102*c* and a second bent portion 102*d*, and arms are bent in different directions. The second bent portion 102*d* functions as an electrical contact with the electrode ring 101.

A mounting plate portions 102*e* of the flat plate fixed closely to the holder 14*a* having a flat internal wall surface perpendicular to the axis of the developing roller 10*d*, is provided with a circular hole 102*f* coaxially with the developing roller 10*d*. The arm portion 102*b* is integral with the mounting plate portion 102*e*, and has the parallel first bent portions 102*c* at diametrically opposite positions of the hole 102*f*. Thus, the electrode plate 102 is mounted to the holder 14*a*.

The arm portion 102*b* is extended along the inside of the hole 102*f*, and a second bent portion 102*d* is provided in the free end portions at the opposite portions of the hole 102*f*.

The mounting plate portion 102*e* is provided with mounting holes 102*e*1, 102*e*2 at the opposite portions of the hole 102*f*. The electrode plate 102 is fixed to the holder 14*a* by screws threaded into the holder 14*a* through the mounting holes 102*e*1, 102*e*2. The contact 102*a* is provided at free ends extended from the center portion of the mounting plate portion 102*e*, and is easily contacted to an electrode of a high-voltage source side of the main assembly 16.

Figure 20:
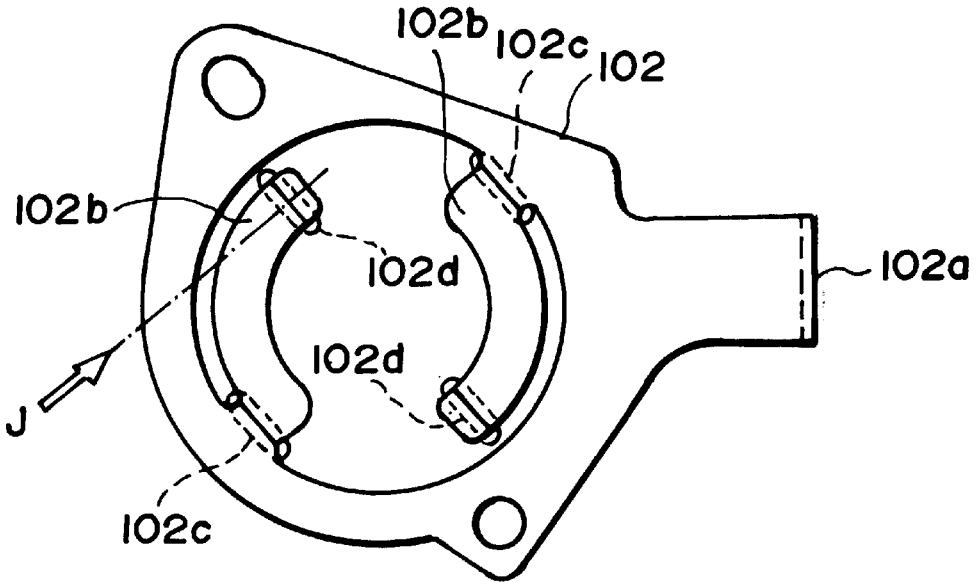
FIG. 20 is a front view illustrating an example of an embodiment of the present invention.
Figure 22:
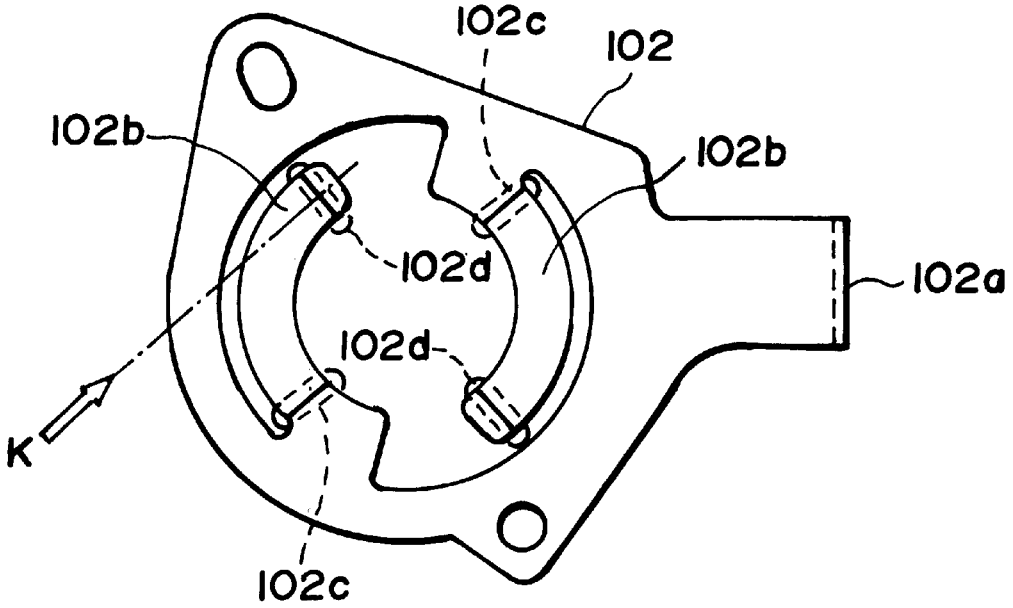
FIG. 22 is a front view illustrating a second example of an embodiment of the present invention.

The first bent portion 102*c* and the second bent portion 102*d* are enclosed by an oval circle of a chain line to indicate the bending (FIGS. 18, 20 and 22).

Figure 19:
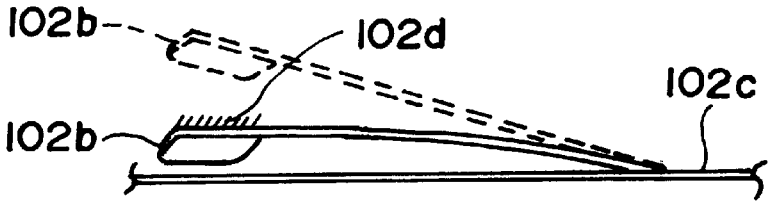
FIG. 19 is a side view illustrating a state of an arm portion of an electrode plate of the present invention.

FIG. 19 is a perspective view as seen from G direction of FIG. 18 to show the bending of one arm portion.

In FIG. 19, the dot lines show the arm portion 102*b* in a free state. Indicated by the solid line is the state of the arm portion 102*b* during the manufacturing step of FIG. 5, wherein the arm portion 102*b* is bent while in contact with the first contact portion 101*a* (FIGS. 11, 12) of the electrode ring 101. By the elastic restoring force, the second bent portion (electrical contact) 102*d* of the arm portion 102*b* of the electrode plate 102 contacts the first contact portion 101*a* of the electrode ring 101 with a predetermined contact pressure, thus assuring electrical conduction.

the connected part 104 is fixed to a predetermined position relative to the flange 12*a*. The axial position of the developing roller 10*d* to which the flange 12*a* is fixed to limited by the bearing members 23*a*, 23*b*. Therefore, the second bent portion (electrical contact) 102*d* of the arm portion 102*b* of the electrode plate 102 is bent to a predetermined position so that the contact force is stable.

In order to avoid the wearing of the contact due to the relative sliding between the second bent portion (electrical contact) 102*d* of the arm portion 102*b* and the first contact portion 101*a* of the electrode ring 101, electroconductive grease is applied between them.

The configuration of the arm portion 102*b* is such that the sliding motion of the first contact portion 101*a* of the electrode ring 101 is codirectional relative to the rotation.

A description will be provided as to an angle H between the first bent portion 102*c* of the electrode plate 102 and the second bent portion 102*d* in this embodiment.

In this embodiment, the arm portion 102*b* of the electrode plate 102 is curved. This is because the size of the part can be reduced when it is curved as shown in FIG. 18 than when it is taken out linearly. However, when the arm portion 102*b* of the electrode plate 102 is bent to a predetermined height as described with FIG. 19, the amount of deformation from the free state is different between the inner and outer sides of the arm portion 102*b*. This will be described with examples.

Example 1

The case when the first bent portion 103*c* of the electrode plate 102 and the second bent portion 102*d* form an angle H which is 0° (parallel) is shown in FIG. 20.

Figure 21:
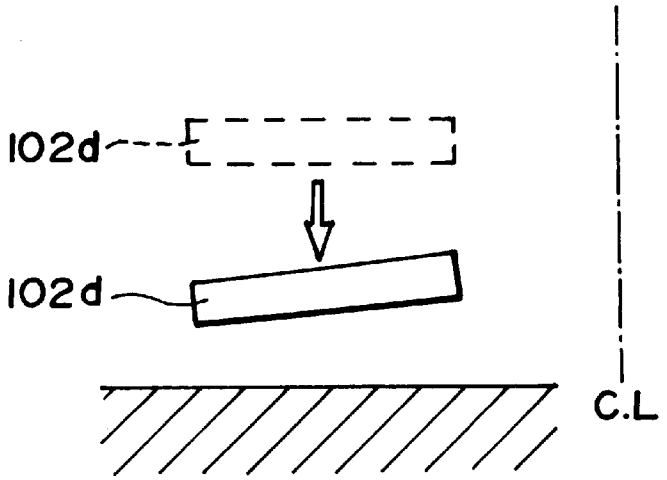
FIG. 21 is a schematic side view illustrating the behavior of an electrical contact portion according to a first example of the present invention.

FIG. 21 shows deformation in a section of the arm portion 102*b* of the electrode plate 102 and the second bent portion (electrical contact) 102*d* as seen in J direction in FIG. 20.

The broken lines indicate the second bent portion 102*d* in the free state, wherein it is horizontal. The solid line indicates the deformed state after assembling. C. L. is a center line of the gear 103. It will be understood that the amount of the deformation is smaller at the side closer to the center line C. L., namely, the inside of the arm portion 102*b* than at the outside. In this state, positive contact occurs at the inside of the first contact portion 102*a* of the electrode ring 101.

Example 2

This example shows the case when the first bent portion 102*c* of the electrode plate 102 and the second bent portion 102*d* form an angle H which is 90° (perpendicular): FIG. 22 shows the electrode plate 102 when the angle E is 90° (perpendicular).

Figure 23:
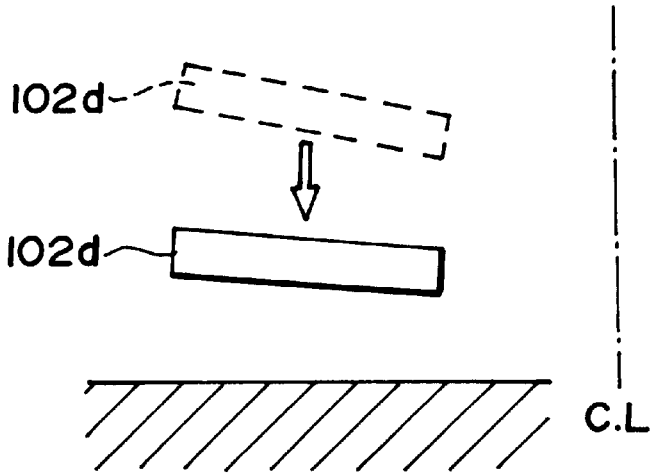
FIG. 23 is a schematic side view illustrating the behavior of an electrical contact portion according to a second example of the present invention.

FIG. 23 shows deformation in a section of the arm portion 102*b* of the electrode plate 102 and the second bent portion (electrical contact) 102*d* as seen in K direction in FIG. 22.

The broken lines indicate the second bent portion 102*d* in the free state, wherein the level is high at the side remote from the center line C. L., namely at the outer side of the arm portion 102*b*. The solid lines indicate the deformed state after assembling, wherein the level is higher at the outer side of the arm portion 102*b* remote from the center line C. L., that is, not horizontal. In this state, contact positively occurs at the outer side of the first contact portion 101*a* of the electrode ring 101.

In each of these examples, it has been confirmed that reliability of the electrical contact is high.

In order to extend the long service life of the contact portion (in view of recycling or use with a large capacity process cartridge or the like), it is desirable that the second bent portion (electrical contact) 102*d* of the arm portion 102*b* contacts the first contact portion 101*a* of the electrode ring 101 in parallel, so that wearing occurs uniformly in the radial direction of the contact.

Using the infinite element method, the single H between the first bent portion 102*c* and the second bent portion 102*d*, to provide the horizontal surface when deformed up to a predetermined height, was calculated, ant the result was about 50°. Through experiments, the parallel contact between the second bent portion (electrical contact) 102*d* of the arm portion 102*b* and the first contact portion 101*a* of the electrode ring 101 has been confirmed in this case. The angle is different when the dimension and material of the arm portion 102*b*, the deformation providing a predetermined load.

With this structure, the bias voltage is supplied assuredly to the developing roller 10*d* through the unshown developing bias contact of the image forming apparatus connected to the voltage source in the main assembly of the image forming apparatus, the first contact 101*a* of the electrode plate 102, the second bent portion 102*d* (electrical contact) of the electrode plate 102, the first contact portion 101*a* of the electrode ring 101, the first bent portion 101*c* (electrical contact) of the electrode ring 101 and the flange 12*a*. Thus, according to the embodiment, when the electric power is supplied from the contact 102*a* of the electrode plate 102 to the developing roller, the power is supplied to the flange 12 through the electrode ring 101. It is further supplied from the flange 12 to the developing roller.

Figure 24:
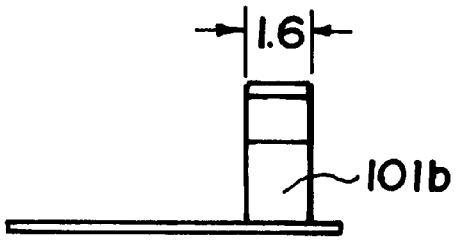
FIG. 24 is a front view, as seen in an axial direction, of an electrical contact part.
Figure 25:
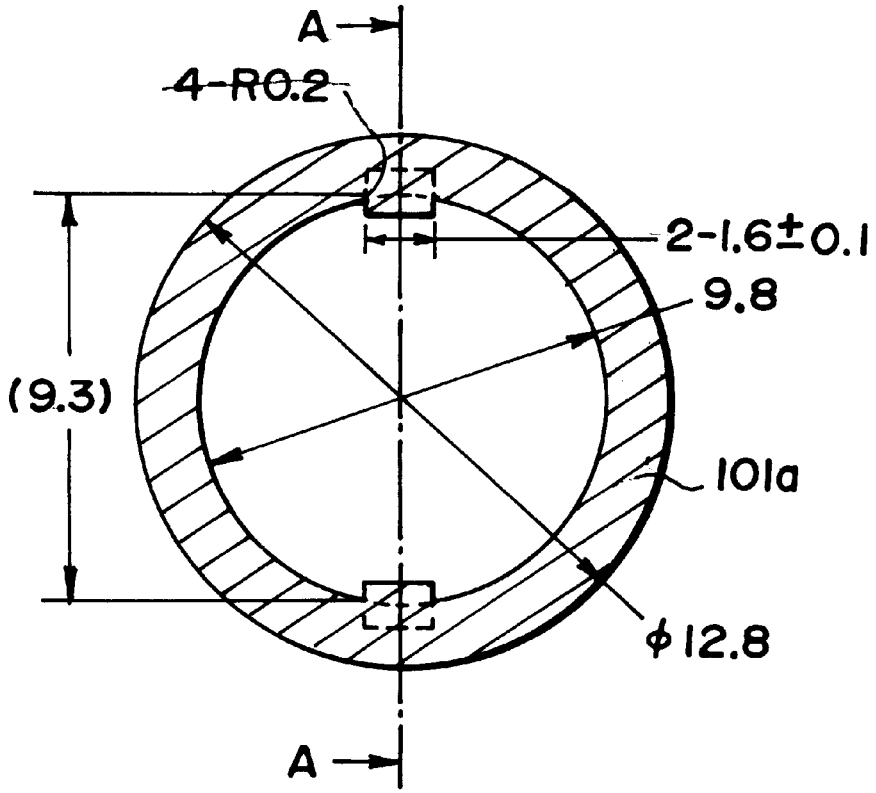
FIG. 25 is a top plan view of the device of FIG. 23.
Figure 26:
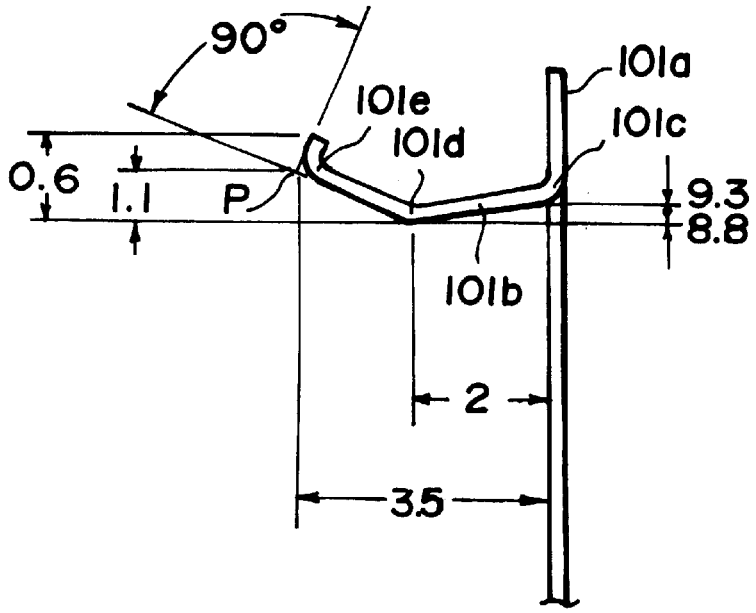
FIG. 26 is an enlarged sectional view of a part of an A—A section of the portion shown in FIG. 23.

FIGS. 24, 25, 26 show the dimensions of the electrode ring 101 according to the embodiment of the present invention. The first contact portion 101*a* has a circular ring shape, wherein the inner diameter is approximately 9.8 mm, the outer diameter is approximately 13.0 mm, the width of the mounting arm portion 101*b* is approximately 1.6 mm, the distance between the first bent portion 101*c* is approximately 9.3 mm, and the distance between the second bent portions 101*d* is approximately 8.8 mm. The distance between the rear side of the ring of the first contact portion 101*a* and an intersection P of an extension of the portion between second bent portion 101*d* and the third one 101*e* and extension of the portion between the third bent portion 101*a* and the free end, is approximately 3.5 mm; and the distance between the back side of the ring of the first contact portion 101*a* and the second bent portion (contact portion) 101*d* is approximately 2 mm; the distance from second bent portion (contact portion) 101*d* to the intersection P in the radial direction is approximately 0.6 mm; and the distance of the arm portion 101*b* is approximately 1.1 mm. The dimensions are indicated on FIG. 26. The electrode ring 1 is a metal plate having a thickness of approximately 0.2 mm.

The inventor carried out experiments to compare the change with time of the electric resistance of the bias contact in actual machines between the structure of Embodiment 1 and the conventional structure.

Figure 27:
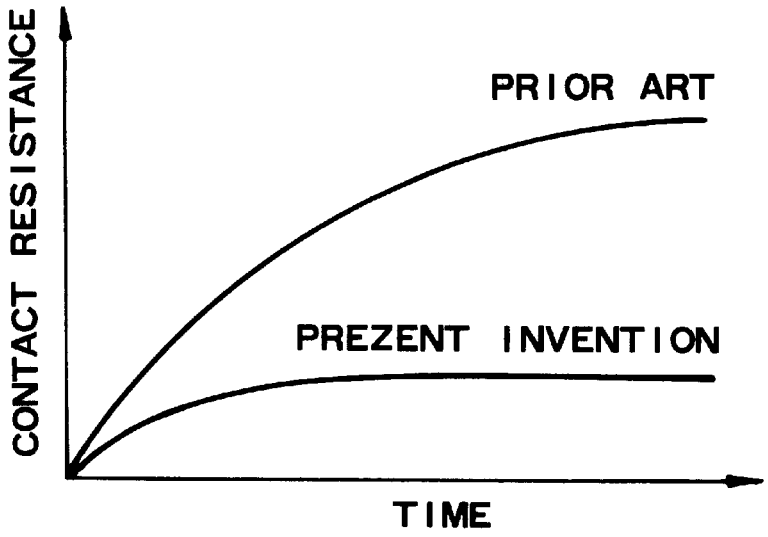
FIG. 27 is a diagram showing a result of measurements of a change of the contact resistance with time in each of a conventional structure and a structure of the present invention.
Figure 28:
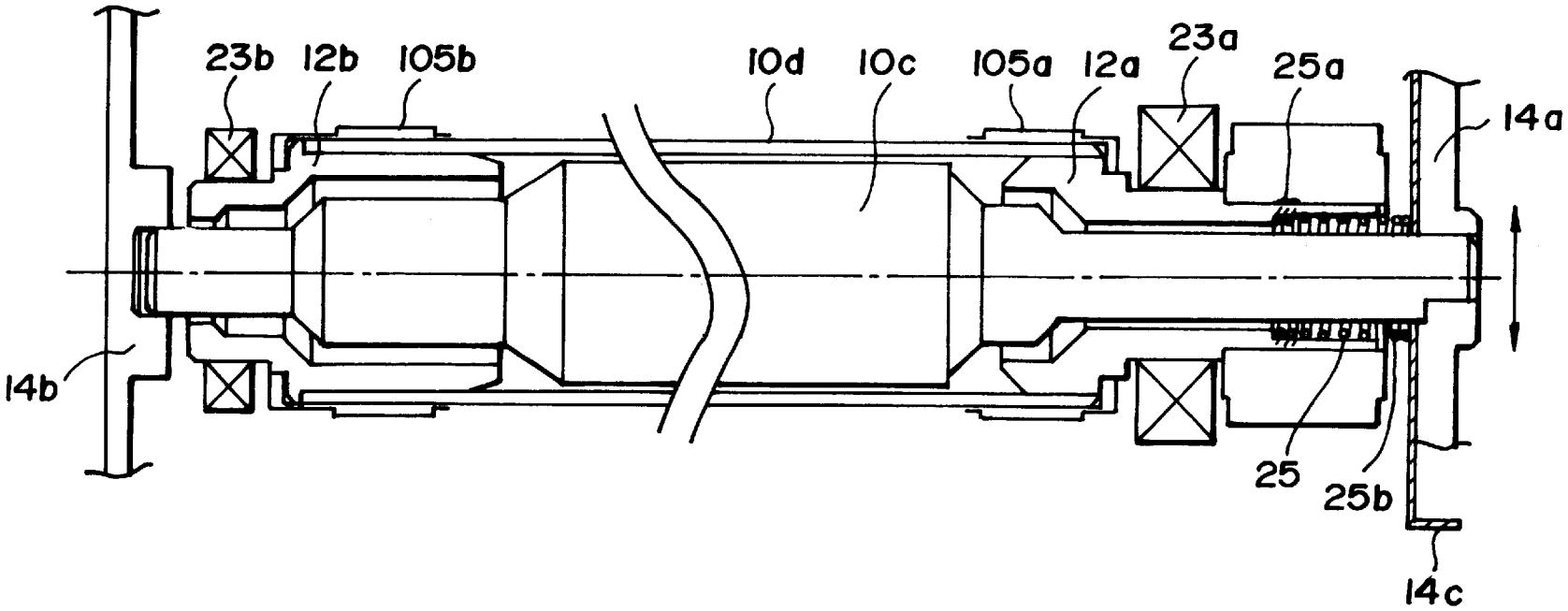
FIG. 28 PRIOR ART
FIG. 28 is a cross-sectional view of a conventional device.

FIG. 27 schematically shows the results.

With the conventional structure, the resistance increases with time, whereas with the present invention, the resistance value increases at the initial state, and then saturates. The resistance value itself is lower in the embodiment than in the conventional structure.

The conventional type is not so bad as to influence the image or the like, but the structure of the present invention is advantageous when the longer service life and further downsizing which are now expected, are considered.

With the electrical contact part according to this embodiment, the mounting position can be visually confirmed when the projected portion is mounted between the flange and the driving portion. The electrical contact part contacts the flange. Therefore, the inspection of the contact portion after the assembling is made easier. The resistance of the electric resistance of the contact is lowered, and therefore, the electrical contact part is suitable to the long service life.

By the use of the electrical contact part in the developing apparatus, the electric resistance relative to the electrode of the developing apparatus can be reduced. The durability of the contact portion increases.

The loss of electric power supplied in the process cartridge is minimized. By the increased durability of the contact portion, the service life of the process cartridge is increased.

The contact position of the electrode member of the flange member side relative to the fixed electrode can be visually inspected when the arm portion is mounted to the flange member. The contact portion contacts the flange member. Therefore, the inspection of the contact portion after the assembling is made easier. The resistance of the electric resistance of the contact is lowered, and therefore, a developing apparatus having a long service life can be provided.

By mounting the arm portion of the flange member side electrode member in an axial space constituted at the outer side of the flange member, the contact portion between the flange-member side electrode member and the flange member can be disposed not at the cost of the strength of the flange member, so that the mechanical strength of the flange member can be assured.

The arm portion has the second contact portion contacting the flange member and the first contact portion contacting the first contact portion abutting the member engaged with the flange member. Therefore, after the first contact portion is assembled so as to contact the member engaged with the flange member, the assembly can be assembled with the flange member, so that assembling is easy.

The surface of the flange member to which the arm portion is contacted faces the surface of the member engaged with the flange member. Therefore, only by the elasticity of the arm portion when the elasticity is given, the mounting arm portion is fixed, and the mounting of the flange member side electrode member is easy.

Only by the provision of the lightened portion at the flat cut of the gear, the arm portion engaging space is provided. Therefore, the present invention is usable only by changing the molding of the gear.

Axially different portions of the arm portion contact the flange member and the gear, the arm portion can be easily deformed, and the flange member side electrode member is not easily removed after mounting.

One of the contacts has a ring shape, and the electric resistance relative to the other part is small. As regards the other contact, the arm portion is bent from the ring-like flat plate to 90 degrees, and the arm portion has elasticity when the arm portion is nipped. Therefore, the mounting is easy, and simultaneously with the mounting, the other contact is connected with another part other than the other parts.

The electrical contact part is not easily removed after assembling.

As described in the foregoing, the assembling operativity of the electrical contact part is improved.

While the invention has been described with reference to the structure disclosed herein, it is not confined to the details set forth and this application is intended to cover such modifications or changes as may come within the purposes of the improvements or the scope of the following claims.

What is claimed is:

1. An electrical contact part for supplying a bias voltage to a developing roller usable in a process cartridge detachably mountable to a main assembly of an electrophotographic image forming apparatus, which contains an electrophotographic photosensitive member, a developing roller for developing an electrostatic latent image formed on the electrophotographic photosensitive member, an electroconductive flange engaged to one end portion of the developing roller, and a driving portion, provided at one end portion of the flange, for rotating the developing roller, said electrical contact part comprising:

(a) a connecting portion electrically connectable with a cartridge-side electrode, which is provided in the process cartridge and which is connectable with a main assembly-side electrode provided in the main assembly of the apparatus when the process cartridge is detachably mounted to the main assembly of the apparatus; and (b) a projected portion projecting from a side opposite from a side at which said connecting portion is connectable to the cartridge-side electrode and insertable between the flange and the driving portion.

2. An electrical contact part according to claim 1, wherein said connecting portion has a flat surface perpendicular to a center of rotation of the developing roller.

3. An electrical contact part according to claim 1, wherein said projected portion is an elastic member having a bent portion which is extended by being inserted.

4. A developing apparatus for developing an electrostatic latent image formed on an electrophotographic photosensitive member with a developer, said developing apparatus comprising:

(a) a developing roller for developing the electrostatic latent image formed on the electrophotographic photosensitive member;

(b) an electroconductive flange provided at one end portion of said developing roller;

(c) a driving portion, provided at one end portion of said flange, for rotating said developing roller:

(d) a developing apparatus side electrode electrically connectable with a main assembly side electrode provided in a main assembly of an image forming apparatus; and (e) an electrical contact part for supplying a bias voltage to said developing roller, said electrical contact part including:

(1) a connecting portion electrically connected with said developing apparatus side electrode; and (2) a projected portion projecting from a side opposite from a side at which said connecting portion is elastically connectable to said developing apparatus side electrode and insertable between said flange and said driving portion.

5. A developing apparatus according to claim 4, wherein said developing apparatus side electrode is provided with an electrical contact portion elastically contacted to said electrical contact part having a flat surface perpendicular to a center of rotation of said developing roller, and said connecting portion of said electrical contact part is provided with a flat surface perpendicular to the center of rotation of said developing roller, wherein said projected portion is an elastic member having a bent portion which is extended by being inserted.

6. A developing apparatus according to claim 4 or 5, wherein said driving portion includes a gear provided coaxially with said developing roller.

7. A process cartridge detachably mountable to a main assembly of an electrophotographic image forming apparatus, comprising:

(a) an electrophotographic photosensitive member;

(b) a developing roller for developing the electrostatic latent image formed on the electrophotographic photosensitive member;

(c) an electroconductive flange provided at one end portion of said developing roller;

(d) a driving portion, provided at one end portion of said flange, for rotating said developing roller;

(e) a cartridge-side electrode electrically connectable with a main assembly side electrode provided in the main assembly of the apparatus, when said process cartridge is detachably mounted to the main assembly of the apparatus; and (f) an electrical contact part for supplying a bias voltage to said developing roller, said electrical contact part including:

(1) a connecting portion electrically connected to said cartridge-side electrode; and (2) a projected portion projecting from a side opposite from a side at which said connecting portion is connectable to said cartridge-side electrode and insertable between said flange and said driving portion.

8. A process cartridge according to claim 7, wherein said cartridge-side electrode is provided with an electrical contact portion elastically contacting said electrical contact part having a flat surface perpendicular to a center of rotation of said developing roller.

9. A process cartridge according to claim 7 to 8, wherein said driving portion includes a gear co-axial with said developer roller.

10. A developing apparatus comprising:

an electroconductive developer carrying member having a hollow cylindrical shape, for feeding a developer to an electrostatic latent image formed on an electrophotographic photosensitive member;

an electroconductive flange fixed to an end of said developer carrying member;

a supporting member, engaged with said flange, for rotatably supporting said developer carrying member;

a flange side electrode member electrically connected to said developer carrying member and provided at an outside of said flange;

a fixed electrode member disposed at a position facing said flange side electrode member and connected with a voltage source;

wherein said fixed electrode member is provided with an elastic contact portion for electrical connection with said flange side electrode member; and wherein said flange side electrode member includes a first contact portion for electrical connection with the elastic contact portion and a second contact portion for electrical abutment connection with said flange.

11. A developing apparatus according to claim 10, wherein said first contact portion is positioned on an end surface of a gear engaged on an outer surface of said flange.

12. A developing apparatus according to claim 11, wherein said second contact portion is engaged in a space between the gear engaged on the outer surface of said flange and the outer surface of said flange.

13. A developing apparatus according to claim 10, wherein said second contact portion is provided at a free end of a bent portion which is best substantially perpendicularly relative to said first contact portion.

14. A developing apparatus for developing an electrostatic latent image formed on an electrophotographic photosensitive member, said developing apparatus comprising:

an electroconductive developer carrying member having a hollow cylindrical shape, for feeding a developer to an electrostatic latent image formed on an electrophotographic photosensitive member;

an electroconductive flange member fixed to an end of said developer carrying member;

a supporting member, engaged with said flange member, for rotatably supporting said developer carrying member;

a drive transmission gear mounted on an outer surface of said flange member against rotation in a rotational direction of the flange member;

a flange-member side electrode member disposed at a side of said gear opposite from a side nearer to the developer carrying member and electrically connected therewith; and a fixed electrode member disposed at a position facing said flange-member side electrode member and connected with a voltage source;

wherein the fixed electrode member is provided with an elastic contact portion for electrical connection with said flange-member side electrode member; and wherein said flange-member side electrode member includes a first contact portion for electrical connection with said elastic contact portion of said fixed electrode member and a second contact portion, extended from said first contact portion, for electrical connection by elastic contact with said flange member, and said extended portion is nipped between an outer periphery of said flange member and the gear.

15. A developing apparatus according to claim 14, wherein said extending portion is inserted into a space formed by a flat surface portion formed on an outer surface of said flange member and a groove formed along a hole for engagement with said flange member.

16. A developing apparatus according to claim 15, wherein said first contact portion is disposed at an end surface of said gear.

17. A process cartridge detachably mountable to a main assembly of an electrophotographic image forming apparatus, comprising:

an electrophotographic photosensitive drum; and developing means for developing an electrostatic latent image formed on said electrophotographic photosensitive drum with a developer;

wherein said developing means includes:

an electroconductive developer carrying member having a hollow cylindrical shape, for feeding a developer to develop the electrostatic latent image;

an electroconductive flange member fixed to an end of said developer carrying member;

a supporting member, engaged with said flange member, for rotatably supporting said developer carrying member;

a flange-member side electrode member electrically connected to said developer carrying member and provided at an outside of said flange member; and a fixed electrode member disposed at a position facing said flange-member side electrode member and connected with a voltage source;

wherein the fixed electrode member is provided with an elastic contact portion for electrical connection with said flange-member side electrode member; and wherein the flange-member side electrode member includes a first contact portion for electrical connection with said elastic contact portion and a second contact portion for electrical abutment connection with said flange member.

18. A process cartridge detachably mountable to a main assembly of an electrophotographic image forming apparatus, comprising:

an electrophotographic photosensitive drum; and developing means for developing a latent image formed on said electrophotographic photosensitive drum with a developer;

wherein said developing means includes:

an electroconductive developer carrying a member having a hollow cylindrical shape, for feeding a developer to an electrostatic latent image formed on an electrophotographic photosensitive drum;

an electroconductive flange fixed to an end of said developer carrying member;

a supporting member, engaged with said flange, for rotatably supporting said developer carrying member;

a drive transmission gear mounted on an outer surface of said flange against rotation in a rotational direction of the flange;

a flange side electrode member disposed at a side of said gear opposite from a side nearer to the developer carrying member and electrically connected therewith; and a fixed electrode member disposed at a position facing said flange side electrode member and connected with a voltage source;

wherein the fixed electrode member is provided with an elastic contact portion for electrical connection with said flange side electrode member; and wherein said flange side electrode member includes a first contact portion for electrical connection with said elastic contact portion of said fixed electrode member and a second contact portion, extended from said first contact portion, for electrical connection by elastic contact with said flange, and said extended portion is nipped between an outer periphery of said flange and the gear.

19. A process cartridge according to claim 18, wherein said first contact portion is positioned on an end surface of said gear engaged on an outer surface of said flange.

20. A process cartridge according to claim 18 or 19, wherein said second contact portion is engaged in a space between said gear engaged on the outer surface of said flange and the outer surface of said flange.

21. A process cartridge according to claim 17 or 18, further comprising at least one of charging means and cleaning means.

22. A process cartridge according to claim 18, wherein said extended portion is inserted into a space formed by a flat surface portion formed on an outer surface of said flange and a groove formed along a hole for engagement with said flange.

23. An electrical contact part for supplying a developing bias to a developing roller for developing an electrostatic latent image formed on an electrophotographic photosensitive member, said electrical contact part comprising:

a circular flat surface portion having a central hole;

an extended portion extended substantially perpendicularly to said flat surface portion from a part of an edge of said hole; and wherein said flat surface portion and said extended portion are made of electroconductive material, and the developing bias is supplied from a main assembly of an electrophotographic image forming apparatus to the developing roller through said flat surface portion and said extended portion.

24. An electrical contact part according to claim 23, wherein said flat surface portion is disposed at an end surface of a gear mounted on one end of the developing roller when said electrical contact part is mounted to one end of the developing roller.

25. An electrical contact part according to claim 23 or 24, wherein said flat surface portion is electrically connected with a fixed electrode mounted to a frame provided adjacent one end of the developing roller, wherein said fixed electrode receives the developing bias for the main assembly of the electrophotographic image forming apparatus.

26. An electrical contact part according to claim 23, wherein when said electrical contact part is mounted to one end of the developer roller, said extended portion is disposed between a gear provided an electroconductive flange provided at one end of the developing roller and the electroconductive flange, and wherein the gear has a gear hole which is engaged with the electroconductive flange.

27. An electrical contact part according to claim 26, wherein the flange is supported on a frame, and the flange has a hole, and wherein a magnet is provided in the developing roller, and a shaft of the magnet penetrates the hole.

28. An electrical contact part according to claim 26 or 27, wherein said extended portion has an elasticity and has a bent portion bent in a radial direction of a circular shape.

29. An electrical contact part according to claim 28, wherein a free end of said extended portion contacts an inner surface of the gear hole of the gear, the gear being made of plastic resin material.

30. An electrical contact part according to claim 28, wherein said bent portion has a first bent portion, a second bent portion and a third bent portion, and said first bent portion is bent inwardly with respect to a radial direction of the circular shape, and wherein the second bent portion is bent outwardly with respect to the radial direction, and the third bent portion is outwardly bent with respect to a radial direction of the circular shape, and wherein said first, second and third bent portions are disposed in the order named from the flat surface portion.

31. An electrical contact part according to claim 30, wherein said second bent portion abuts a part of an outer surface of said flange.

32. An electrical contact part according to claim 23, 24, or 26, wherein said electrical contact part is made of metal.

33. A electrical contact part according to claim 32, wherein said metal is a copper alloy or a Fe alloy.

34. A electrical contact part according to claim 23, wherein said electrical contact part is used with a developing apparatus, and wherein to developing apparatus develops the electrostatic latent image formed on an electrophotographic photosensitive member with a developer.

35. An electrical contact part according to claim 23, wherein a process cartridge contains, as a unit, the developing roller and the electrophotographic photosensitive member, wherein said electrical contact part is configured to be usable with the process cartridge, the process cartridge being detachably mountable to the main assembly of the electrophotographic image forming apparatus.

36. A developing apparatus for developing an electrostatic latent image formed on an electrophotographic photosensitive member, said developing apparatus comprising:

(a) a developing roller for developing an electrostatic latent image formed on said electrophotographic photosensitive member with a developer;

(b) a fixed electrode provided on a frame of said developing apparatus;

(c) an electrical contact part for supplying a developing bias to said developing roller, said electrical contact part including:

a circular flat surface portion having a central hole, wherein said flat surface portion is electrically connected to said fixed electrode; and an extended portion extended substantially perpendicularly to said flat surface portion from a part of an edge of said hole;

wherein said flat surface portion and said extended portion are made of electroconductive material, and the developing bias is supplied from a main assembly of an electrophotographic image forming apparatus to said developing roller through said flat surface portion and said extended portion.

37. A developing apparatus according to claim 36, wherein said flat surface portion is disposed at an end surface of a gear mounted to one end of said developing roller, and wherein the gear receives a driving force for rotating said developing roller.

38. A developing apparatus according to claim 36, wherein said fixed electrode has an elastic portion extending from said frame, and said elastic portion is elastically contacted to said flat surface portion, wherein said fixed electrode receives the developing bias from the main assembly of the electrophotographic image forming apparatus.

39. A developing apparatus according to claim 36, wherein said extended portion is disposed between an electroconductive flange provided at one end of said developing roller and a gear provided on the flange, wherein the gear has a gear hole which is engaged with said extend portion.

40. A developing apparatus according to claim 39, wherein the flange is supported on said frame, and the flange has a hole, and wherein a magnet is disposed in said developing roller, and the magnet penetrates said hole, and a shaft of the magnet is supported on said frame.

41. A developing apparatus according to claim 39 or 40, wherein said extend portion has an elasticity and has a bent portion bent in a radial direction of a circular shape.

42. A developing apparatus according to claim 41, wherein a free end of said extended portion contacts an inner surface of the gear hole of said gear, the gear being made of plastic resin material.

43. A developing apparatus according to claim 42, wherein said bent portion has a first bent portion, a second bent portion and a third bent portion, and said first bent portion is bent inwardly with respect to a radial direction of the circular shape, and wherein the second bent portion is bent outwardly with respect to the radial direction, and the third bent portion is outwardly bent with respect to a radial direction of the circular shape, and wherein said first, second and third bent portions are disposed in the order named from the flat surface portion.

44. A developing apparatus according to claim 43, wherein said second bent portion abuts a part of an outer surface of said flange.

45. A developing apparatus according to claim 36, 37, 39 or 40 wherein said electrical contact part is made of metal.

46. A developing apparatus according to claim 45, wherein said metal is a copper alloy or a Fe alloy.

47. A developing apparatus according to claim 36, wherein a process cartridge contains, as a unit, said developing apparatus and the electrophotographic photosensitive member, wherein said developing apparatus is provided in the process cartridge, said process cartridge being detachably mountable to the main assembly of the electrophotographic image forming apparatus.

48. A process cartridge detachably mountable to a main assembly of an electrophotographic image forming apparatus, comprising:

(a) an electrophotographic photosensitive member; and (b) a developing device for developing an electrostatic latent image formed on said electrophotographic photosensitive member, said developing device comprising:

a developing roller for developing an electrostatic latent image formed on said electrophotographic photosensitive member with a developer;

a fixed electrode provided on a frame;

an electrical contact part for supplying a developing bias to said developing roller, said electrical contact part including:

a circular flat surface portion having a central hole, wherein said flat surface portion is electrically connected to said fixed electrode; and an extended portion extended substantially perpendicularly to said flat surface portion from a part of an edge of said hole;

wherein said flat surface portion and said extended portion are made of electroconductive material, and the developing bias is supplied from the main assembly of electrophotographic image forming apparatus to said developing roller through said flat surface portion and said extended portion.

49. A process cartridge according to claim 48, wherein said flat surface portion is disposed at an end surface of a gear mounted to one end of said developing roller, and wherein the gear receives a driving force for rotating said developing roller.

50. A process cartridge according to claim 48, wherein said fixed electrode has an elastic portion extending from said frame, and said elastic portion is elastically contacted to said flat surface portion, wherein said fixed electrode receives the developing bias from the main assembly of the electrophotographic image forming apparatus.

51. A process cartridge according to claim 48, wherein said extended portion is disposed between an electroconductive flange provided at one end of said developing roller and a gear provided on the flange, wherein the gear has a gear hole with which the extended portion is engaged.

52. A process cartridge according to claim 51, wherein the flange is supported on said frame, and the flange has a hole, and wherein a magnet is disposed in said developing roller, and the magnet penetrates the hole, and a shaft of the magnet is supported on said frame.

53. A process cartridge according to claim 51 or 52, wherein said extended portion has an elasticity and has a bent portion bent in radial direction of a circular shape.

54. A process cartridge according to claim 53, wherein a free end of said extended portion contacts an inner surface of the gear hole of the gear, the gear being made of plastic resin material.

55. A process cartridge according to claim 54, wherein said bent portion has a first bent portion, a second bend and a third bent portion, and said first bent portion is bent inwardly with respect to a radial direction of the circular shape, and wherein the second bent portion is bent outwardly with respect to the radial direction, and the third bent portion is outwardly bent with respect to a radial direction of the circular shape, and wherein said first, second and third bent portions are disposed in the order named from the flat surface portion.

56. A process cartridge according to claim 55, wherein said second bent portion abuts a part of an outer surface of the flange.

57. A process cartridge according to claim 48, 49, 51, 52, 54 or 56, wherein said electrical contact part is made of metal.

58. A process cartridge according to claim 57, wherein said metal is a copper alloy or a Fe alloy.

* * * * *

UNITED STATES PATENT AND TRADEMARK OFFICE

CERTIFICATE OF CORRECTION

PATENT NO. : 6,275,668 B1
DATED : August 14, 2001
INVENTOR(S) : Yoshiyuki Batori It is certified that error appears in the above-identified patent and that said Letters Patent is hereby corrected as shown below:

Title page,
Item [57], ABSTRACT,
Line 9, “on” should read -- one --.

Drawings,
Sheet No. 16, Figure 27, “PREZENT” should read -- PRESENT --.

Column 1,
Line 14, “machines,” should read -- machine, --.

Column 2,
Line 45, “and” should read -- an --.

Column 5,
Line 53, “ably” should read -- able --.
Line 60, “18a” should read -- 18a having --.

Column 7,
Line 40, “resin” should read -- the resin --.
Line 56, “103 b” should read -- 103b --.

Column 9,
Line 39, “abutts” should read -- abuts --.
Line 45, “arises.” should read -- arise. --.
Line 51, “and” (2nd occurrence) should read -- end --.

Column 10,
Line 50, “the” should read -- The --.
Line 52, “to” (2nd occurrence) should read -- is --.

Column 12,
Line 8, “the” (2nd occurrence) should be deleted.

Column 14,
Line 26, “roller:” should read -- roller; --.

UNITED STATES PATENT AND TRADEMARK OFFICE

CERTIFICATE OF CORRECTION

PATENT NO. : 6,275,668 B1
DATED : August 14, 2001
INVENTOR(S) : Yoshiyuki Batori It is certified that error appears in the above-identified patent and that said Letters Patent is hereby corrected as shown below:

Column 15,
Line 21, “developer” should read -- developing --.

Column 16,
Line 23, “extending” should read -- extended --.

Column 19,
Line 29, “extend” should read -- extended --.

Column 20,
Line 48, “bend” should read -- bent --.

Signed and Sealed this

Thirtieth Day of July, 2002

*Attest:*

*Attesting Officer*

JAMES E. ROGAN
*Director of the United States Patent and Trademark Office*